US011702278B2

(12) United States Patent
Kochanowski

(10) Patent No.: US 11,702,278 B2
(45) **Date of Patent: *Jul. 18, 2023**

(54) COMPONENTS AND END WALLS FOR FREIGHT CONTAINER

(71) Applicant: George E. Kochanowski, Springboro, OH (US)

(72) Inventor: George E. Kochanowski, Springboro, OH (US)

( * ) Notice: Subject to any disclaimer, the term of this patent is extended or adjusted under 35 U.S.C. 154(b) by 9 days.

This patent is subject to a terminal disclaimer.

(21) Appl. No.: 17/380,130

(22) Filed: Jul. 20, 2021

(65) Prior Publication Data

US 2022/0009705 A1 Jan. 13, 2022

Related U.S. Application Data

(63) Continuation of application No. 16/781,241, filed on Feb. 4, 2020, now Pat. No. 11,066,234, which is a (Continued)

(51) Int. Cl.
*B65D 90/00* (2006.01)
*B65D 90/08* (2006.01)
*B65D 88/52* (2006.01)

(52) U.S. Cl.
CPC ..... *B65D 90/0026* (2013.01); *B65D 88/522* (2013.01); *B65D 88/524* (2013.01); *B65D 90/08* (2013.01)

(58) Field of Classification Search
CPC ..... B65D 88/127; B65D 2590/0016; B65D 90/0013; B65D 90/0033; B65D 90/008; (Continued)

(56) References Cited

U.S. PATENT DOCUMENTS 3,456,830 A * 7/1969 Golder ..... B65D 90/008 220/668
4,844,672 A 7/1989 Yurgevich
(Continued)

FOREIGN PATENT DOCUMENTS

DE 2624928 12/1977

OTHER PUBLICATIONS

International Search Report & Written Opinion for related PCT Application No. PCT/US2015/016862, dated Jun. 30, 2015 (15 pgs).

(Continued)

*Primary Examiner* — Shawn M Braden
(74) *Attorney, Agent, or Firm* — Brooks, Cameron & Huebsch, PLLC

(57) ABSTRACT

The present disclosure provides for end walls for a freight container. The end walls include those for a rear wall and a front wall for the freight container. The rear wall includes rear corner posts each having a recess to receive a rear door hinge in the rear corner post and a corner fitting mounting block. The rear wall further includes corner fittings each having a receiving block, a sill member connected to a first rear corner posts by a member hinge, a header member connected to a second rear corner posts by a member hinge, a first rear wall door and a second rear wall door. The front wall includes front corner posts having gussets, anti-racking blocks, corner fittings with receiving blocks, a sill member, a header member and a front wall door.

7 Claims, 20 Drawing Sheets

Related U.S. Application Data continuation of application No. 15/120,203, filed as application No. PCT/US2015/016862 on Feb. 20, 2015, now Pat. No. 10,549,908.

(60) Provisional application No. 61/942,306, filed on Feb. 20, 2014.

(58) Field of Classification Search
CPC ..... B65D 88/121; B65D 90/0026; B65D 88/129; B65D 90/02; B65D 90/028
See application file for complete search history.

(56) References Cited

U.S. PATENT DOCUMENTS

| | | | | |
|---|---|---|---|---|
| 6,109,052 | A | 8/2000 | Austin | |
| 2004/0262305 | A1 | 12/2004 | Myers | |
| 2006/0056935 | A1 | 3/2006 | Li et al. | |
| 2013/0313269 | A1* | 11/2013 | Peterson | B65D 90/0026 220/629 |
| 2015/0344223 | A1* | 12/2015 | Hwang | B65D 90/0013 220/1.5 |
| 2016/0052709 | A1 | 2/2016 | Kochanowski | |
| 2017/0044753 | A1 | 2/2017 | Bowron et al. | |

OTHER PUBLICATIONS

International Preliminary Report on Patentability for related PCT Application No. PCT/US2015/016862, dated Sep. 1, 2016 (11 pgs).

* cited by examiner

COMPONENTS AND END WALLS FOR FREIGHT CONTAINER

This application is a Continuation of U.S. application Ser. No. 16/781,241, filed Feb. 4, 2020, published as U.S. 2020/0180859 A1, and issued as U.S. Pat. No. 11,066,234, on Jul. 20, 2021, which is a Continuation of U.S. National Stage application Ser. No. 15/120,203, filed Aug. 19, 2016, published as U.S. 2017/0057739 A1, and issued as U.S. Pat. No. 10,549,908, on Feb. 4, 2020, which is a § 371 of International Application Number PCT/US2015/016862, filed Feb. 20, 2015 and published as WO 2015/127236 on Aug. 27, 2015, which claims the benefit to U.S. Provisional Application 61/942,306, filed Feb. 20, 2014, the entire contents of which are incorporated herein by reference in its entirety.

FIELD OF DISCLOSURE

Embodiments of the present disclosure are directed to a freight container; more specifically, embodiments are directed to end walls for freight containers including reversibly foldable freight containers.

BACKGROUND

Freight containers are used for transferring goods from one location to another location. Freight containers may be transferred via a number of different modes such as, overseas transfer, rail transfer, air transfer, and trailer (e.g., tractor trailer) transfer.

To help improve efficiencies freight containers have been standardized. One such standardization is overseen by the International Organization for Standardization, which may be referred to as "ISO." The ISO publishes and maintains standards for freight containers. These ISO standards for freight containers help provide that each freight container has similar physical properties. Examples of these physical properties include, but are not limited to, width, height, depth, base, maximum load, and shape of the freight containers.

In addition to ISO standards, there are also other technical requirements placed on freight containers through the "International Convention for Safe Containers" or "CSC." The CSC provides requirements which individual components must meet and provides tests for lifting from top corner castings, lifting from bottom corner castings, lifting using other additional devices on the container such as forklift pockets, grappler arm positions and other methods. The test procedures also extend to stacking and to concentrated loads on roof and floor.

Transverse racking is another aspect which is subject to testing. In a transvers racking test an externally applied force is applied at the top corner fitting to strain or stretch the end structures of the freight container laterally and longitudinally. This is done to simulate the strains applied to the freight container from loaded containers positioned above the freight container. Passing the transverse racking test helps to better ensure the design of the freight container will be able to withstand the transverse forces encountered during transport. However, even with required CSC standards, freight containers still fail under transverse racking forces. As such, improvements to the design and strength of freight containers are always needed in the art.

SUMMARY

The embodiments of the present disclosure provide for a rear wall and a front wall of a freight container, where the rear wall and the front wall may help to improve the strength of freight containers, especially reversibly foldable freight containers. Each of the rear wall and the front wall include corner posts and corner fittings that allow for a sill member and a header member to each move relative the corner posts from a first position in which the member is seated and locked relative the corner fitting to a second position in which the member is free to move (e.g., pivot) relative the corner post to which the member is attached by a member hinge. Once in this second position, the freight container can be folded, as discussed herein.

With respect to the corner fitting of the present disclosure, the corner fitting for the freight container includes a first major wall having a surface defining an opening through the first major wall; a second major wall spaced apart from and parallel with the first major wall; a first end wall perpendicular to and extending between the first major wall and the second major wall; a second end wall perpendicular to and extending between the first major wall and the second major wall, and spaced apart from and parallel with the first end wall; a first side wall perpendicular to and extending between the first major wall and the second major wall, and perpendicular to and extending between the first end wall and the second end wall, where the first side wall includes a surface defining an opening through the first side wall; a second side wall perpendicular to and extending between the first major wall and the second major wall, perpendicular to and extending between the first end wall and the second end wall and that is spaced apart from and parallel with the first side wall, where the first major wall, the second major wall, the first end wall, the second end wall, the first side wall and the second side wall define a volume that can receive a cone of a twistlock. The first major wall, the second major wall, the first end wall, the second end wall, the first side wall and the second side wall of the corner fitting discussed herein can each have a dimension that conform to the specifications of International Organization for Standardization (ISO) 1161 for corner fittings of series 1 freight containers.

The corner fitting further includes a receiving block that extends away from both the first side wall and the second side wall, where the receiving block has a socket that can receive a bolt. Specifically, the receiving block includes a bolt receiving surface parallel with the second side wall and perpendicular to the lower surface of the receiving block, the bolt receiving surface having a first bolt socket and a second bolt socket spaced apart from the first bolt socket, where the first bolt socket and the second bolt socket extend into the receiving block towards the second side wall. The receiving block further includes a lower surface parallel with the second major wall. A bolt can extends from the lower surface of the receiving block. For example, the receiving block can includes a first bolt and a second bolt spaced apart from the first bolt, where each of the first bolt and the second bolt extend from the lower surface. The lower surface of the receiving block can also include a socket that extends from the lower surface into the receiving block. For example, the receiving block can includes a first socket and a second socket spaced apart from the first socket, where each of the first socket and the second socket extend from the lower surface into the receiving block.

The receiving block can further include an angle support portion having a first end surface that forms a receiving block ledge with the lower surface and a corner post mounting leg that extends perpendicularly away from the second major wall of the corner fittings. The angle support portion can be formed from a single block of a metal. The corner fittings of the present disclosure can further include a portion of a member hinge, such as, for example, a knuckle to receive a hinge pin or additional locking device.

Various embodiments of the corner fittings can be used with the corner post of the present disclosure. Such corner posts include a rear corner post and a front corner post. The rear corner post for the freight container according to the present disclosure includes an elongate exterior bar having a first elongate edge and a second elongate edge spaced apart from the first elongate edge, where the first elongate edge and the second elongate edge join a first major surface and a second major surface of the elongate exterior bar; a support beam attached to the first major surface of the elongate exterior bar, the support beam and the elongate exterior bar each having: a first surface and a second surface that extend toward the first elongate edge of the elongate exterior bar; and a third surface that joins the first surface and the second surface to form a recess to receive a rear door hinge in the rear corner post; and where the support beam includes a fourth surface and a fifth surface extending from a first end surface of the support beam to a sixth surface to form a corner fitting mounting block. The rear corner post of the present disclosure can further include a corner fitting, as discussed herein, where the receiving block includes an angle support portion with a first end surface that forms a receiving block ledge with the lower surface of the receiving block and a corner post mounting leg that extends perpendicularly away from the second major wall of the corner fittings, where the angle support portion is positioned on at least a portion of a first end of the support beam and the corner post mounting leg is positioned between the corner fitting mounting block and at least a portion of the elongate exterior bar.

The rear corner post can be used in a rear wall of the freight container, where the rear wall includes a first rear corner post and a second rear corner post, each of the first rear corner post and the second rear corner post having the components discussed herein (e.g., above), including the corner fittings. The rear wall further includes a sill member having a first end, a second end opposite from the first end and a member hinge, where the member hinge connects the first end of the sill member to the first rear corner post and allows the sill member to move relative the first rear corner post and the second rear corner post, and the second end includes a sill ledge that can seat against the receiving block ledge of the corner fitting to create an elongate planar sill surface that is substantially parallel with the first end of the support beam of the first rear corner post and the second rear corner post; a header member having a first end, a second end opposite from the first end and a member hinge, where the member hinge connects the first end of the header member to the second rear corner post and allows the header member to move relative the first rear corner post and the second rear corner post, and the second end includes a header ledge that can seat against the receiving block ledge of the corner fitting to create an elongate planar header surface that is substantially parallel with the first end of the support beam of the first rear corner post and the second rear corner post; and a first rear wall door and a second rear wall door. Each of the first rear wall door and the second rear wall door include two or more rear door hinges, where each rear door hinge is at least partially positioned in the recess to join the first rear wall door to the first rear corner post and to join the second rear wall door to the second rear corner post. The first rear wall door and the second rear wall door can move relative to each other and to the first rear corner post and the second rear corner post on the two or more rear door hinges.

Each of the sill member and the header member can further include a bolt catch to lock and unlock the sill member to the first rear corner post and the header member to the second rear corner post. For the bolt catch, the second end of each of the sill member and the header member include an end face having a first surface and a second surface that define a first opening and a second opening, respectively, through the second end of each of the sill member and the header member that extend to a bolt catch housing in each of the second end of the sill member and the second end of the header member. The bolt catch housing contains a first guide block and a second guide block each having an elongate guide slot; a moveable dowel block positioned between the first guide block and the second guide block, the moveable dowel block being a rectangular cuboid having: a first major surface and a second major surface opposite the first major surface; a first end surface and a second end surface opposite the first end surface; a top surface and a bottom surface opposite the top surface; a first bolt and a second bolt extending away from the first major surface, the first bolt and the second bolt being spaced apart from each other, where the first bolt is at least partially positioned through the first opening in the end face and the second bolt is at least partially positioned through the second opening in the end face; and a guide surface that forms an elongate drive slot through the top surface and the bottom surface of the moveable dowel block, the elongate drive slot extending between the first end surface and the second end surface with a first end of the elongate drive slot being closer to the first major surface than the second major surface, and a second end the elongate drive slot being closer to the second major surface than the first major surface; an elongate cam keeper having a helical guide slot, the elongate cam keeper being rotatably mounted in the bolt catch housing; a handle extending from the elongate cam keeper to allow the elongate cam keeper to rotate in the bolt catch housing; and a drive pin having a first end and a second end, where the drive pin passes from the elongate guide slot of the first guide block through the elongate drive slot of the moveable dowel block and the elongate guide slot of the second guide block to position the second end of the drive pin in the helical guide slot of the elongate cam keeper, where rotating the handle extending from the elongate cam keeper in a first direction causes the moveable dowel block to move the first bolt and the second bolt through the first opening and the second opening, respectively, so that at least a portion of the first bolt and the second bolt extend beyond the end face and where rotating the handle extending from the elongate cam keeper in a second direction opposite the first direction causes the moveable dowel block to retract at least a portion of the first bolt and the second bolt through the first opening and the second opening, respectively. The receiving block includes a first socket and a second socket to receive the first bolt and the second bolt of the bolt catch.

For the rear wall, the receiving block can further include a first bolt and a second bolt separate from the first bolt that extend from the receiving block ledge. The sill ledge also includes a first socket and a second socket to receive the first bolt and the second bolt extending from the receiving block ledge, when the sill ledge seats against the receiving block ledge of the corner fitting to create the elongate planar sill surface that is substantially parallel with the first end of the support beam of the first rear corner post and the second rear corner post.

Similarly, the header ledge of the rear wall can also include a first socket and a second socket to receive the first bolt and the second bolt when the header ledge seats against the receiving block ledge of the corner fittings to create the elongate planar header surface that is substantially parallel with the first end of the support beam of the first rear corner post and the second rear corner post.

The present disclosure also includes embodiments of the front corner post. The front corner post for the freight container include an elongate exterior corner bar having: an outer corner extending between a first exterior wall and a second exterior wall; a first extension wall parallel with the first exterior wall and projecting perpendicularly away from the second exterior wall to a first elongate edge; and a second elongate edge spaced apart from the first elongate edge, where the first elongate edge and the second elongate edge generally face the same direction; an elongate interior corner bar having: a first portion parallel with and joined to the first extension wall of the elongate exterior corner bar; a second portion parallel with and joined to the first exterior wall; a first interior wall extending from the second portion, the first interior wall parallel with the second exterior wall of the elongate exterior corner bar; a second interior wall extending from the first portion, the second interior wall parallel with the first interior wall; and a door interface wall parallel with the first exterior wall, where the door interface wall connects the first interior wall and the second interior wall of the elongate interior corner bar. The front corner post also includes a gusset extending across an enclosed area defined by the elongate exterior corner bar and the elongate interior corner bar; and an anti-racking block on a surface of the door interface wall opposite the gusset.

The elongate exterior corner bar and the elongate interior corner bar of the front corner post can each further include an end, where the front corner post further includes a corner fitting on the end of the elongate exterior corner bar and the elongate interior corner bar. As discussed herein, the corner fittings can include the first major wall, the second major wall, the first end wall, the second end wall, the first side wall and the second side wall to define the volume that can receive a cone of a twistlock, and the receiving block that extends away from both the first side wall and the second side wall. The corner fittings for the front corner post can further include a corner post insert extending from the second major wall, where the corner post insert fits into the enclosed area defined by the elongate exterior corner bar and the elongate interior corner bar with a peripheral surface of the corner post insert seated against an interior surface of each of the first exterior wall, the second exterior wall, the first portion of the elongate interior corner bar, the second portion of the elongate interior corner bar, the first interior wall of the elongate interior corner bar, the second interior wall of the elongate interior corner bar and the door interface wall of the elongate interior corner bar. The anti-racking block on the surface of the door interface wall opposite the gusset can also include a surface defining an opening through at least the anti-racking block.

The front corner post can be used in a front wall of the freight container, where the front wall includes a first front corner post and a second front corner post, each of the first front corner post and the second front corner post having the components discussed herein (e.g., above), including the corner fittings with the corner post insert. The front wall further includes a sill member having a first end, a second end opposite from the first end and a member hinge, where the member hinge connects the first end of the sill member to the first corner post and allows the sill member to move relative the first front corner post and the second front corner post, and the second end includes a sill ledge that can seat against a portion of the receiving block of the corner fittings to create an elongate planar sill surface that is substantially perpendicular with to the door interface wall of the first front corner post and the second front corner post; a header member having a first end, a second end opposite from the first end and a member hinge, where the member hinge connects the first end of the header member to the second front corner post and allows the header member to move relative the first front corner post and the second front corner post, and the second end includes a header ledge that can seat against a portion of the receiving block of the corner fittings to create an elongate planar header surface that is substantially perpendicular with to the door interface wall of the first front corner post and the second front corner post.

The front wall of the freight container further includes a front wall door having a second anti-racking block and two or more front door hinges that join the front wall door and the first front corner post, where the front wall door can move relative the first front corner post on the two or more front door hinges to position the second anti-racking block adjacent the anti-racking block on the surface of the door interface wall opposite the gusset. Each of the sill member and the header member can further include the bolt catch to lock and unlock the sill member to the first front corner post and the header member to the second front corner post, where the bolt catch is as described herein (e.g., above). The receiving block on the corner fittings of the front wall can also include a first socket and a second socket that receives the first bolt and the second bolt of the bolt catch. In addition, the receiving block can also include a first end surface and a lower surface that form a receiving block ledge, where a first bolt and a second bolt separate from the first bolt extend from the receiving block ledge. The sill ledge includes a first socket and a second socket to receive the first bolt and the second bolt when the sill ledge seats against the receiving block ledge of the corner fittings to create the elongate planar sill surface that is substantially perpendicular with to the door interface wall of the first front corner post and the second front corner post. The header ledge can include a first socket and a second socket to receive the first bolt and the second bolt when the header ledge seats against the receiving block ledge of the corner fittings to create the elongate planar header surface that is substantially perpendicular with to the door interface wall of the first front corner post and the second front corner post. The front wall door can also include a front door latching bolt that extends into the opening of the anti-racking block on the surface of the door interface when the front wall door is in a closed position.

The above summary of the present disclosure is not intended to describe each disclosed embodiment or every implementation of the present disclosure. The description that follows more particularly exemplifies illustrative embodiments. In several places throughout the application, guidance is provided through lists of examples, which examples can be used in various combinations. In each instance, the recited list serves only as a representative group and should not be interpreted as an exclusive list.

DETAILED DESCRIPTION

Figure 1A:
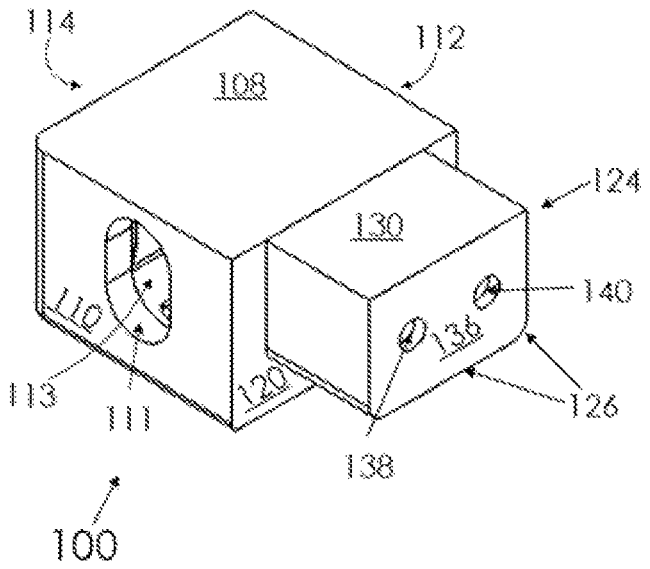
FIGS. 1A-1H provide embodiments of a corner fitting according to the present disclosure.

Freight containers (also known as containers, shipping containers, intermodal containers and/or ISO containers, among other names) can be transported by rail, air, road and/or water. Freight containers are often times transported empty. Because the freight container occupies the same volume whether it contains goods or not, the cost (both financial and environmental) to transport an empty freight container can be equivalent to the cost of transporting a full freight container. For example, the same number of trucks (e.g., five) would be needed to transport the same number of empty freight containers (e.g., five). In addition, freight containers often times sit empty at storage facilities and/or transportation hubs. Regardless of where the freight container is located (in transit or in storage) the volume an empty freight container occupies is not being used to its full potential.

One solution to these issues would be a reversibly foldable freight container, as is discussed herein. Having a reversibly foldable freight container would allow for an "empty" freight container to be folded to achieve a volume that is smaller than its fully expanded state. This extra volume acquired by at least partially folding the freight container could then be used to accommodate other at least partially folded freight containers, provide additional volume for non-foldable (e.g., regular) freight containers and/or foldable freight containers in their fully expanded state. So, for example, a number of reversibly foldable freight containers that are empty (e.g., five) could be folded and nested in such a way that one truck could transport the number of empty freight containers. As a result the environmental and cost savings are expected to be significant.

Examples of such reversibly foldable freight containers include those discussed in co-pending U.S. patent application Ser. No. 14/072,180 entitled "Stackable and Collapsible Container"; U.S. patent application Ser. No. 14/239,041 entitled "Jointed Member"; U.S. patent application Ser. No. 14/238,881 entitled "Door Assembly For Freight Container"; U.S. patent application Ser. No. 14/238,893 entitled "Reversibly Foldable Freight Container" and U.S. patent application Ser. No. 14/238,919 entitled "Abutment Joint", all of which are incorporated herein by reference in their entirety. The inventive embodiments provided herein are directed to and useful with reversibly foldable freight containers, such as those referenced and incorporated herein.

Embodiments of the present disclosure provide a rear wall and a front wall of a foldable freight container. The rear wall and the front wall of the present disclosure may help to improve the strength of freight containers, especially foldable freight containers. Each of the rear wall and the front wall include corner posts and corner fittings that allow for a sill member and a header member to each move relative the corner posts from a first position in which the member is seated and locked relative the corner fitting to a second position in which the member is free to move (e.g., pivot) relative the corner post to which the member is attached by a member hinge. Once in this second position, the freight container can be folded, as discussed herein.

As used herein, "a," "an," "the," "at least one," and "one or more" are used interchangeably. The term "and/or" means one, one or more, or all of the listed items. The recitations of numerical ranges by endpoints include all numbers subsumed within that range (e.g., 1 to 5 includes 1, 1.5, 2, 2.75, 3, 3.80, 4, 5, etc.). The terms "parallel," "perpendicular" and "planar" can each be modified by the word "substantially" if so desired (e.g., "substantially parallel", "substantially perpendicular" and "substantially planar."

The figures herein follow a numbering convention in which the first digit or digits correspond to the drawing figure number and the remaining digits identify an element in the drawing. Similar elements between different figures may be identified by the use of similar digits. For example, 3166 may reference element "166" in FIG. 3, and a similar element may be referenced as 4166 in FIG. 4. It is emphasized that the purpose of the figures is to illustrate and the figures are not intended to be limiting in any way. The figures herein may not be to scale and relationships of elements in the figures may be exaggerated. The figures are employed to illustrate conceptual structures and methods herein described.

Figure 1B:
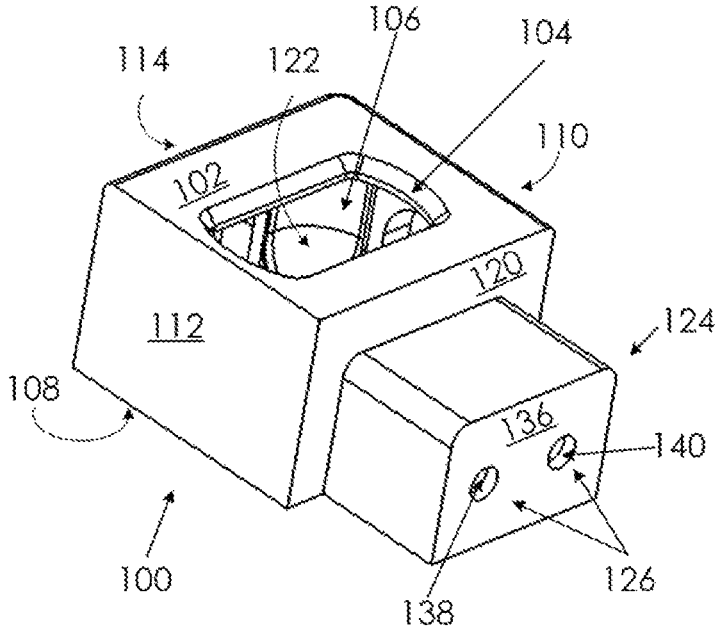
Figure 1C:
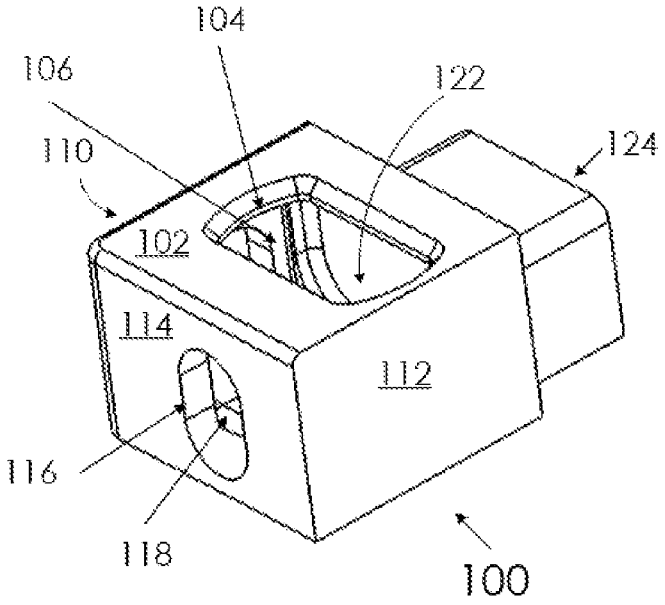

Referring now to FIGS. 1A-1H, there are provided different embodiments of a corner fitting 100 for a freight container according the present disclosure. The corner fitting 100 in each of the embodiments include certain structures that are seen in each of the embodiments. FIGS. 1A-1C provide an example of the corner fitting 100 that includes such structures. As seen in FIGS. 1A-1C, the corner fitting 100 for the freight container includes a first major wall 102 having a surface 104 defining an opening 106 through the first major wall 102 (e.g., FIGS. 1B and 1C); a second major wall 108 (e.g., FIGS. 1A and 1B) spaced apart from and parallel with the first major wall 102; a first end wall 110 (e.g., FIGS. 1A and 1B) perpendicular to and extending between the first major wall 102 and the second major wall 108, where the first end wall 110 includes a surface 111 defining an opening 113 through the first end wall 110; a second end wall 112 (e.g., FIGS. 1A-1C) perpendicular to and extending between the first major wall 102 and the second major wall 108, and spaced apart from and parallel with the first end wall 110; a first side wall 114 (e.g., FIGS. 1A-1C) perpendicular to and extending between the first major wall 102 and the second major wall 108, and perpendicular to and extending between the first end wall 110 and the second end wall 112, where the first side wall 114 includes a surface 116 defining an opening 118 through the first side wall 114; a second side wall 120 (FIGS. 1A-1B) perpendicular to and extending between the first major wall 102 and the second major wall 108, perpendicular to and extending between the first end wall 110 and the second end wall 112 and that is spaced apart from and parallel with the first side wall 114.

Interior surfaces of the first major wall 102, the second major wall 108, the first end wall 110, the second end wall 112, the first side wall 114 and the second side wall 120 also help to define a volume 122 that can receive a cone of a twistlock. As appreciated by one skilled in the art, a twistlock can include a Tantlinger lock (a twistlock mounted to a corner casting) that forms a standardized rotating connector for securing a freight container to a vehicle (e.g., a semi-trailer or a railway container train car), a container ship or for lifting of the freight container by container cranes and sidelifters. The cone of the twistlock can be inserted into the volume 122 through at least opening 106 in the first major wall 102 of the corner fitting 100. The other openings 113 and 118 can also be used to receive any one of a hook, a chain and/or lashing hardware.

The corner fitting 100 can also include portions that conform to the specifications of International Organization for Standardization (ISO) 1161 for corner fittings of series 1 freight containers. For example, each of the first major wall 102, the second major wall 108, the first end wall 110, the second end wall 112, the first side wall 114 and the second side wall 120 has a dimension that conform to the specifications of International Organization for Standardization (ISO) 1161 for corner fittings of series 1 freight containers, where ISO 1161 is incorporated herein by reference in its entirety.

The corner fitting 100 further includes a receiving block 124 that extends away from both the first side wall 114 and the second side wall 120. The receiving block 124 includes a socket 126 that can receive a bolt and, as illustrated in FIG. 1A, the receiving block 124 includes a lower surface 130 that is parallel with the second major wall 108. FIGS. 1A-1B provide an embodiment in which two of the socket 126 are present in the receiving block 124. As illustrated in FIGS. 1A-1B, the receiving block 124 includes a bolt receiving surface 136 parallel with the second side wall 120 and perpendicular to the lower surface 130 of the receiving block 124. The bolt receiving surface 136 has a first bolt socket 138 and a second bolt socket 140 spaced apart from the first bolt socket 138, where the first bolt socket 138 and the second bolt socket 140 extend into the receiving block 124 towards the second side wall 120.

As will be discussed and illustrated herein, a bolt is a metal pin that can inserted and removed from a socket (e.g., socket 126) for helping to secure and stabilize at least two parts that are joined once the bolt is received in the socket. The bolts discussed herein can have a cross-sectional shape that corresponds and allows them to be inserted into the socket. For example, the bolt can have a circular cross-section with a diameter of 10 millimeter (mm) to 30 mm, where the socket has a surface defining a circular opening that can receive the bolt in a close fitting relationship with the surface of the socket. In a preferred embodiment, the bolt has a circular cross-section with a diameter of 20 mm.

The portions of the bolt that engages the socket do not include threads. As illustrated in FIGS. 1A-1C, the sockets 126 are positioned and configured to receive bolts from a bolt catch that helps to lock and unlock a sill member and/or a header member to either a front corner post or a rear corner post, as will be more fully discussed herein. Additional sockets and/or sockets in different locations, as discussed herein, can also be present in the receiving block 124.

Figure 1D:
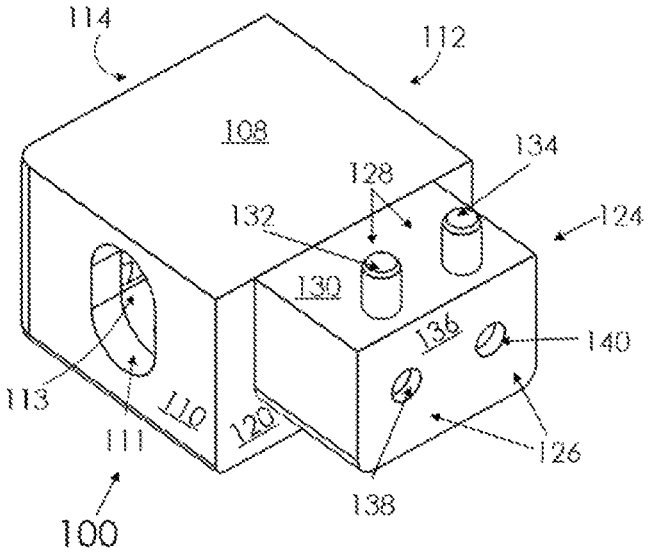

Referring now to FIG. 1D, there is shown an additional embodiment of the corner fitting 100. As illustrated, the corner fitting 100 includes the structures discussed above for FIGS. 1A-1C. In addition, the corner fitting 100 illustrated in FIG. 1D includes a bolt 128 extending from the lower surface 130 of the receiving block 124. Specifically, the corner fitting 100 of FIG. 1D illustrates the receiving block 124 having a first bolt 132 and a second bolt 134 spaced apart from the first bolt 132, where each of the first bolt 132 and the second bolt 134 extend from the lower surface 130. As discussed herein, the first bolt 132 and the second bolt 134 are received in either a sill ledge of a sill member or a header ledge of a header member.

Figure 1E:
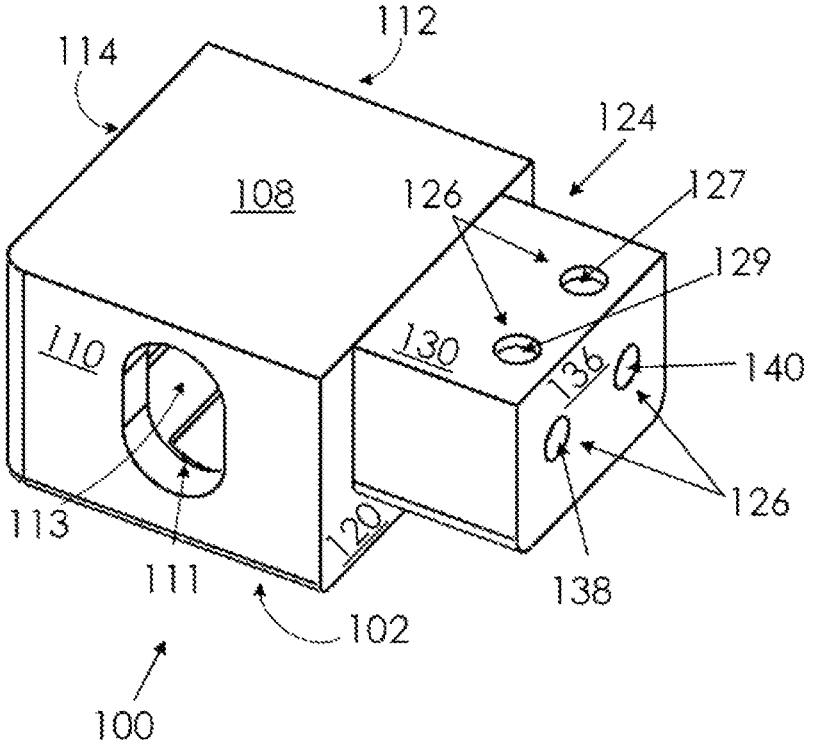

FIG. 1E provides an illustration of yet a further embodiment of the corner fitting 100. As illustrated, the corner fitting 100 of FIG. 1E includes the structures discussed above for FIGS. 1A-1C. In addition, the corner fitting 100 illustrated in FIG. 1E includes sockets 126 extending from the lower surface 130 into the receiving block 124. As illustrated the receiving block 124 includes a first socket 127 and a second socket 129 spaced apart from the first socket 127, where each of the first socket 127 and the second socket 129 extend from the lower surface 130 into the receiving block 124.

Figure 1F:
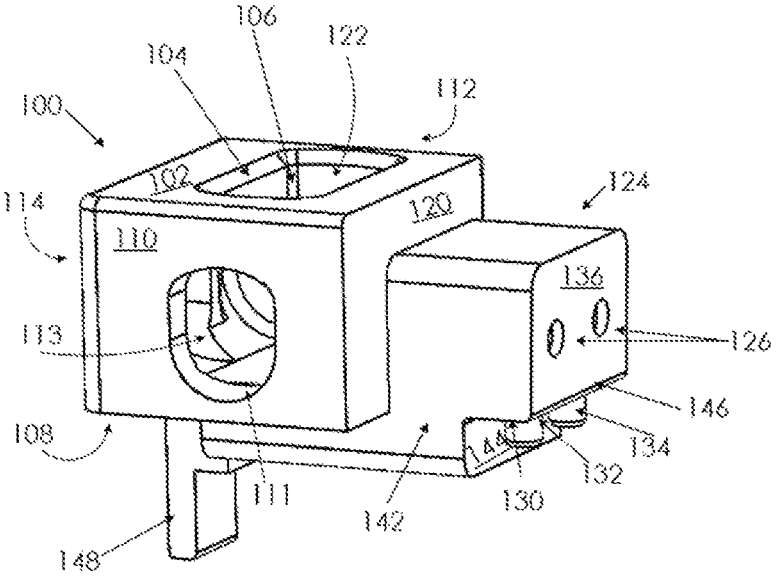

FIG. 1F provides an additional illustration of an embodiment of the corner fitting 100. As illustrated, the corner fitting 100 of FIG. 1F includes the structures discussed above for FIGS. 1A-1D. In addition, the receiving block 124 illustrated in FIG. 1F further includes an angle support portion 142. The angle support portion 142 includes a first end surface 144 that forms a receiving block ledge 146 with the lower surface 130 and a corner post mounting leg 148 that extends perpendicularly away from the second major wall 108 of the corner fittings 100. The receiving block 124 with the angle support portion 142 can be formed from a single block of a metal. In other words, it is possible for a single block of a metal to be used to form the receiving block 124 and the angle support portion 142 as one single continuous structure.

Figure 1G:
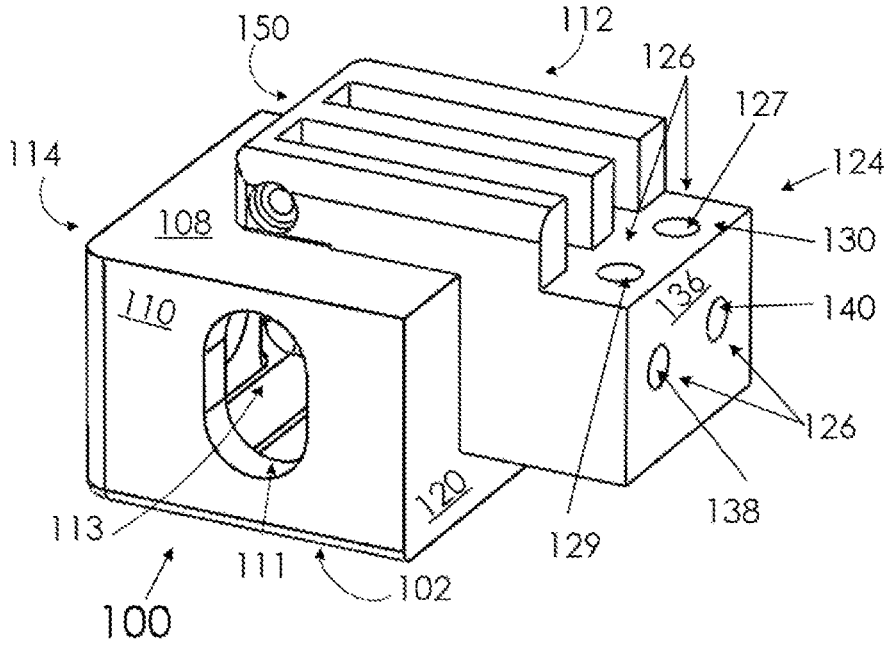

FIG. 1G provides an additional illustration of an embodiment of the corner fitting 100. As illustrated, the corner fitting 100 of FIG. 1G includes the structures discussed above for FIGS. 1A-1C and 1E. In addition, the receiving block 124 illustrated in FIG. 1G further includes a portion of a member hinge 150. As discussed herein, the portion of the member hinge 150 is independently joined with a member hinge portion of a sill member and a header member, discussed more fully herein, where the member hinge allows the sill member and/or the header member to move relative the rear corner posts and/or the front corner posts. As illustrated in FIG. 1G, the portion of the member hinge 150 is a knuckle of the member hinge 150, through which a pin of the member hinge 150 can be passed.

Figure 1H:
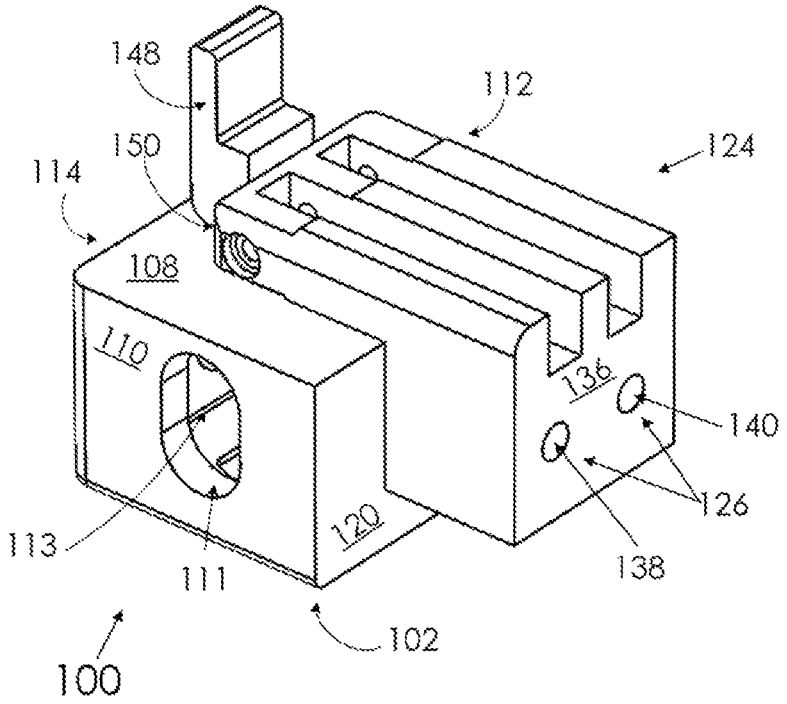

FIG. 1H provides an additional illustration of an embodiment of the corner fitting 100. As illustrated, the corner fitting 100 of FIG. 1H includes the structures discussed above for FIG. 1G. In addition, the receiving block 124 illustrated in FIG. 1H further includes the corner post mounting leg 148, as discussed for FIG. 1F.

The corner fitting 100 illustrated in FIGS. 1A-1H with their receiving block 124 sockets and bolts, when present, can be formed of materials suitable for and built so as to comply with ISO standard 1496-1 (fifth edition 1990-08-15) and its amendments, which are all incorporated herein by reference in its entirety. For the various embodiments, the corner fitting 100 illustrated in FIGS. 1A-1H can be formed of steel. Examples of such steel include, but are not limited to, 'weathering steel' as specified within standard BS EN 10025-5:2004, which is also known as CORTEN steel. It is possible to form the corner fitting 100 illustrated in FIGS. 1A-1H in a number of different processes. For example, the corner fitting 100 illustrated in FIGS. 1A-1H can be cast from steel as a single piece. Alternatively, two or more pieces of the corner fitting 100 (e.g., the receiving block 124 and a corner fitting of a series 1 freight container that conforms to ISO 1161) as illustrated in FIGS. 1A-1H can be welded (e.g., arc welding or TIG welding) to form the corner fitting 100. Sockets 126 can be formed in either the casting process or in a machining operation (e.g., drilled out to form socket 126).

Figure 2A:
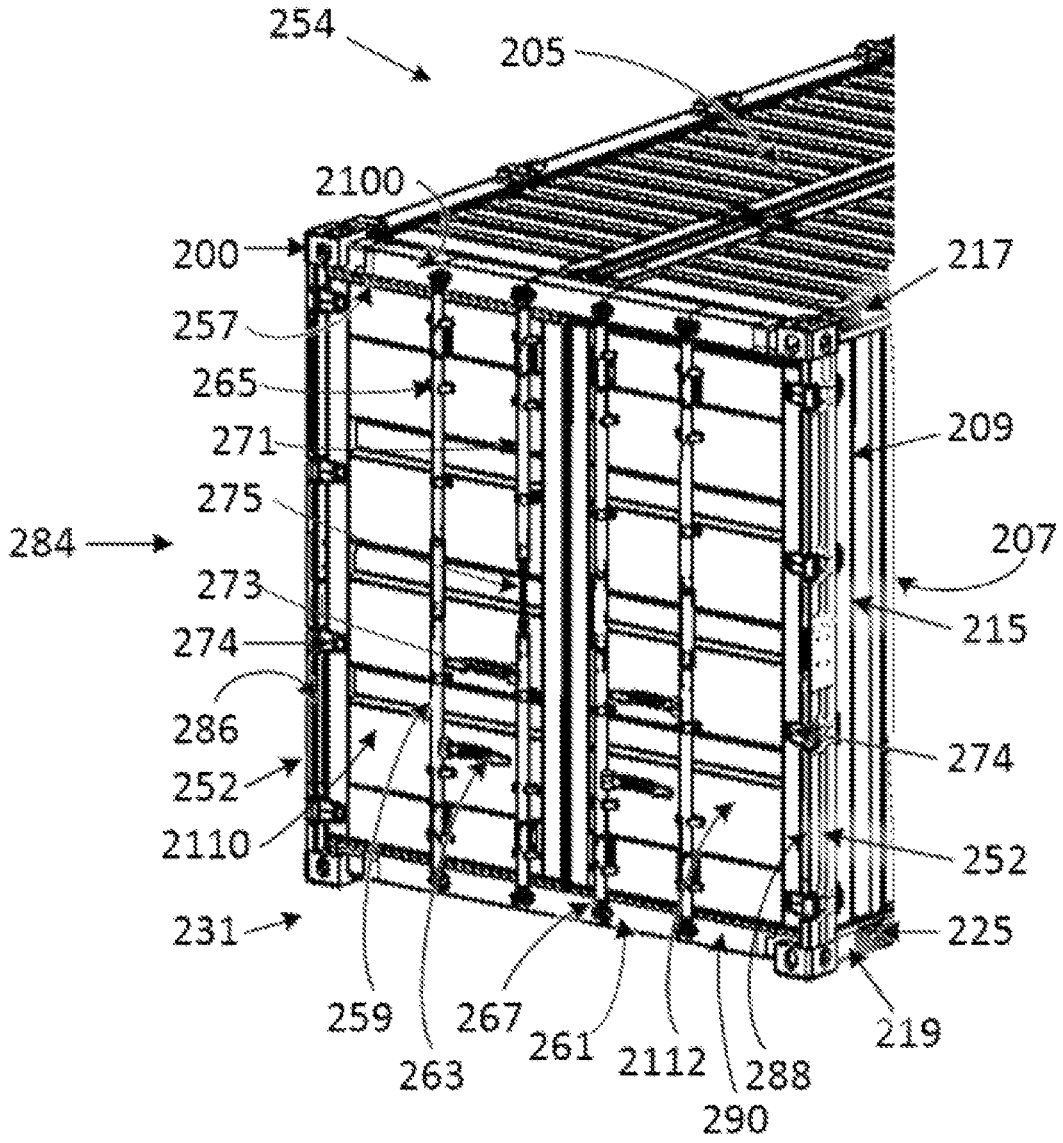
FIGS. 2A and 2B provides a perspective view of a rear wall of a freight container according to the present disclosure.
Figure 2B:
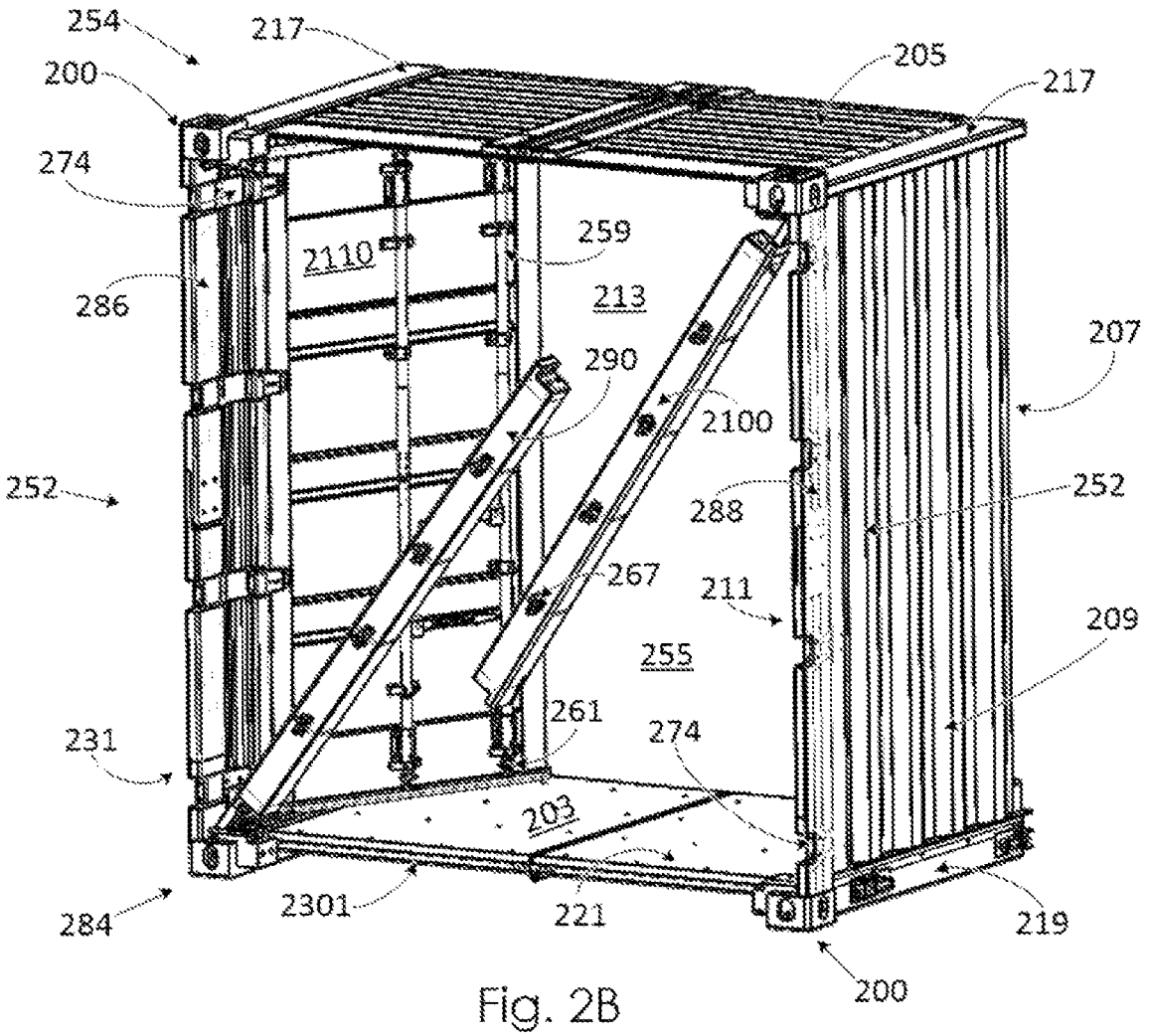

Referring now to FIGS. 2A and 2B, there is shown a perspective view of a rear wall 284 of a freight container 254 (partial views) according to the present disclosure. As illustrated, the freight container 254 includes a floor structure 203 (FIG. 2B), a roof structure 205 opposite the floor structure 203, and a sidewall structure 207 that joins the floor structure 203 and the roof structure 205. Each of the sidewall structures 207 has an exterior surface 209 and an interior surface 211 (FIG. 2B), where the interior surface 211 of the sidewall structures 207, the floor structure 203 and the roof structure 205 at least partially defines a volume 213 (FIG. 2B) of the freight container 254.

The sidewall structure 207 includes a sidewall panel 215 that is joined to an upper side rail 217 and a bottom side rail 219. The floor structure 203 (FIG. 2B) includes flooring 221 (FIG. 2B) that is attached to cross members 2301, where the cross members 2301 are joined to the bottom side rail 219. The bottom side rail 219 can further include forklift pockets 225.

As illustrated, the rear wall 284 of the freight container 254 is joined with the roof structure 205, the floor structure 203 and the sidewall structures 207. The rear wall 284 includes two of a rear corner post 252 (a first rear corner post 286 and a second rear corner post 288), a rear door hinge 274, a corner fitting 200, a sill member 290, a header member 2100, a first rear wall door 2110 and a second rear wall door 2112. The first rear corner post 286 and the second rear corner post 288 extend between and join to the sill member 290 and the header member 2100 through the corner fittings 200 to form a rear end frame 231. FIG. 2A illustrates the rear end frame 231 having both the sill member 290 and the header member 2100 in their closed and locked state (as will be discussed more fully herein), while FIG. 2B illustrates the rear end frame 231 having both the sill member 290 and the header member 2100 in their unlocked and open state (as will be discussed more fully herein).

Each of the first rear wall door 2110 and the second rear wall door 2112 are attached to the first rear corner post 286 and the second rear corner post 288, respectively, with two or more of the rear door hinges 274. Each of the first rear wall door 2110 and the second rear wall door 2112 has a height and a width that allows the doors 2110 and 2112 to fit within an area 255 (FIG. 2B) defined by the rear end frame 231. Each of the first rear wall door 2110 and the second rear wall door 2112 can further include a gasket 257 around its perimeter to help provide weatherproofing on the exterior portion of the rear wall 284.

Each of the first rear wall door 2110 and the second rear wall door 2112 further include a locking rod 259 having a cam 261 and a handle 263. The locking rod 259 can be mounted to the rear wall door 2110, 2112 with a bearing bracket assembly 265, where the locking rod 259 turns within and is guided by the bearing bracket assembly 265 to engage and disengage the cam 261 and a cam keeper 267. The cam keeper 267 is mounted on the rear end frame 231, specifically the cam keeper 237 is mounted on the header member 2100 and the sill member 290 of the end frame 231 of the rear wall 284.

The locking rod 259 mounted to first rear wall door 2110 and the second rear wall door 2112 can move between a first predetermined position where the cam 261 is aligned with and can engage the cam keeper 267, as discussed above, and a second predetermined position. In the second predetermined position the cam 261 is disengaged from the cam keeper 267 and has a position relative the end frame 231 that allows the cam 261 and each of the first rear wall door 2110 and the second rear wall door 2112 to travel through the area 255, past the rear end frame 231 and the cam keeper 267 of the rear wall 284, and into the volume 213 of the freight container 254. In other words, in the second predetermined position portions of the locking rod 259 have been moved, as described herein, so as to position the cam 261 directly adjacent the surface of the first rear wall door 2110 and the second rear wall door 2112 so that each of the first rear wall door 2110 and the second rear wall door 2112 can be opened into the volume 213 of the freight container 254. As discussed herein, opening each of the first rear wall door 2110 and the second rear wall door 2112 into the volume 213 of the freight container 254 is accomplished, in addition to having the locking rod 259 in the second predetermined position, with the use of the rear door hinge 274, as will be more fully discussed herein.

For the various embodiments, the first predetermined position is shown in FIG. 2A, where the cam 261 and the cam keeper 267 are positioned relative each other so the cam 261 can engage and disengage the cam keeper 267 positioned on the rear end frame 231. FIG. 2B provides an illustration of the cam 261 in at least one embodiment of the second predetermined position relative the cam keeper 267. As illustrated in FIG. 2B, the cam 261 has been positioned, relative the first predetermined position, so that the cam 261 is no longer aligned so as to engage and/or disengage the cam keeper 267. The cam 261 is also positioned relative the rear end frame 231 such that the cam 261 can pass through the area 255 defined by the rear end frame 231 as the first rear wall door 2110 and the second rear wall door 2112 travel into the volume 213 of the freight container 254, where the volume 213 can be defined, at least in part, by surfaces of the floor structure 203, the roof structure 205, the sidewall structure 207 and the rear wall 284.

For the various embodiments, moving the cam 261 between the first predetermined position and the second predetermined position can be accomplished in a number of different ways. For example, the locking rod 259 can have two or more portions that can telescope along a longitudinal axis of the locking rod 259. The locking rod 259 can include a first portion 271 and a second portion 273 joined to the first portion with a connection shaft 275. The first portion and the second portion can telescope relative the connection shaft to change a length of the locking rod 259. For example, the first portion 271 and the second portion 273 can travel along the connection shaft between the first predetermined position and the second predetermined position. The connection shaft 275 can be held in place on the first rear wall door 2110 and the second rear wall door 2112 with a combination of the bearing bracket assembly 265 and an anti-rack ring. For the various embodiments, the anti-rack ring can be joined to the connection shaft 275 on either end of the bearing bracket assembly 265 such that the shaft 275 can rotate in the bearing bracket assembly 265 by turning handle 263, but will not pass vertically, relative the floor structure 203 and/or the roof structure 205, through the bearing bracket assembly 265 (e.g., the connection shaft 275 will not move up and/or down relative the bearing bracket assembly 265) due to the presences of the anti-rack ring. These embodiments, along with embodiments of the floor structure 203, the roof structure 205, the sidewall structure 207, the sidewall panel 215, the upper side rail 217, the bottom side rail 219, the flooring 221, the cross members 2301, the rear door hinges 274, the locking rod 259 having the cam 261 and the handle 263, the bearing bracket assembly 265 and the cam keeper 267 are more fully discussed in co-pending U.S. patent application Ser. No. 14/238,881 entitled "Door Assembly For Freight Container," which is incorporated herein by reference in its entirety.

Figure 3A:
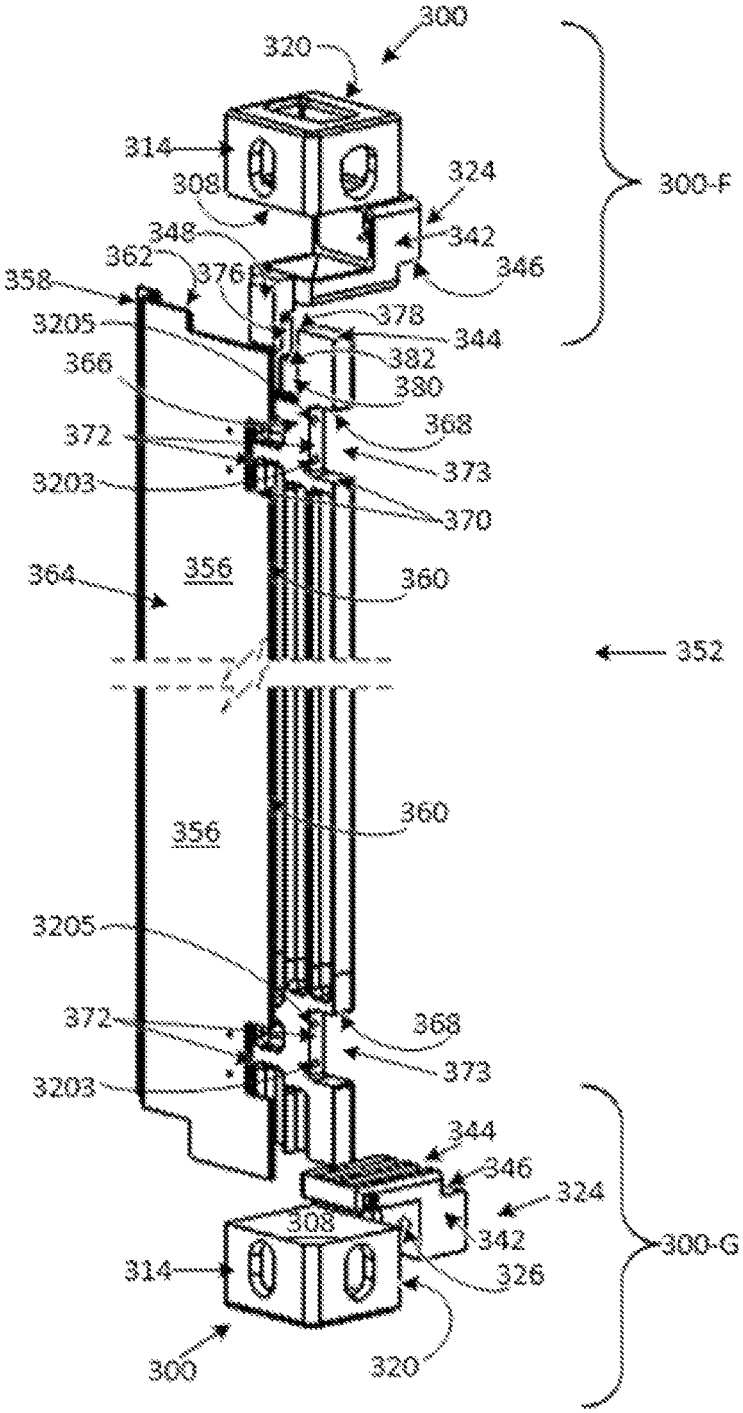
FIGS. 3A-3C provide views of a rear corner post (FIGS. 3A and 3B) and a rear door hinge (FIG. 3C) according to the present disclosure.
Figure 3B:
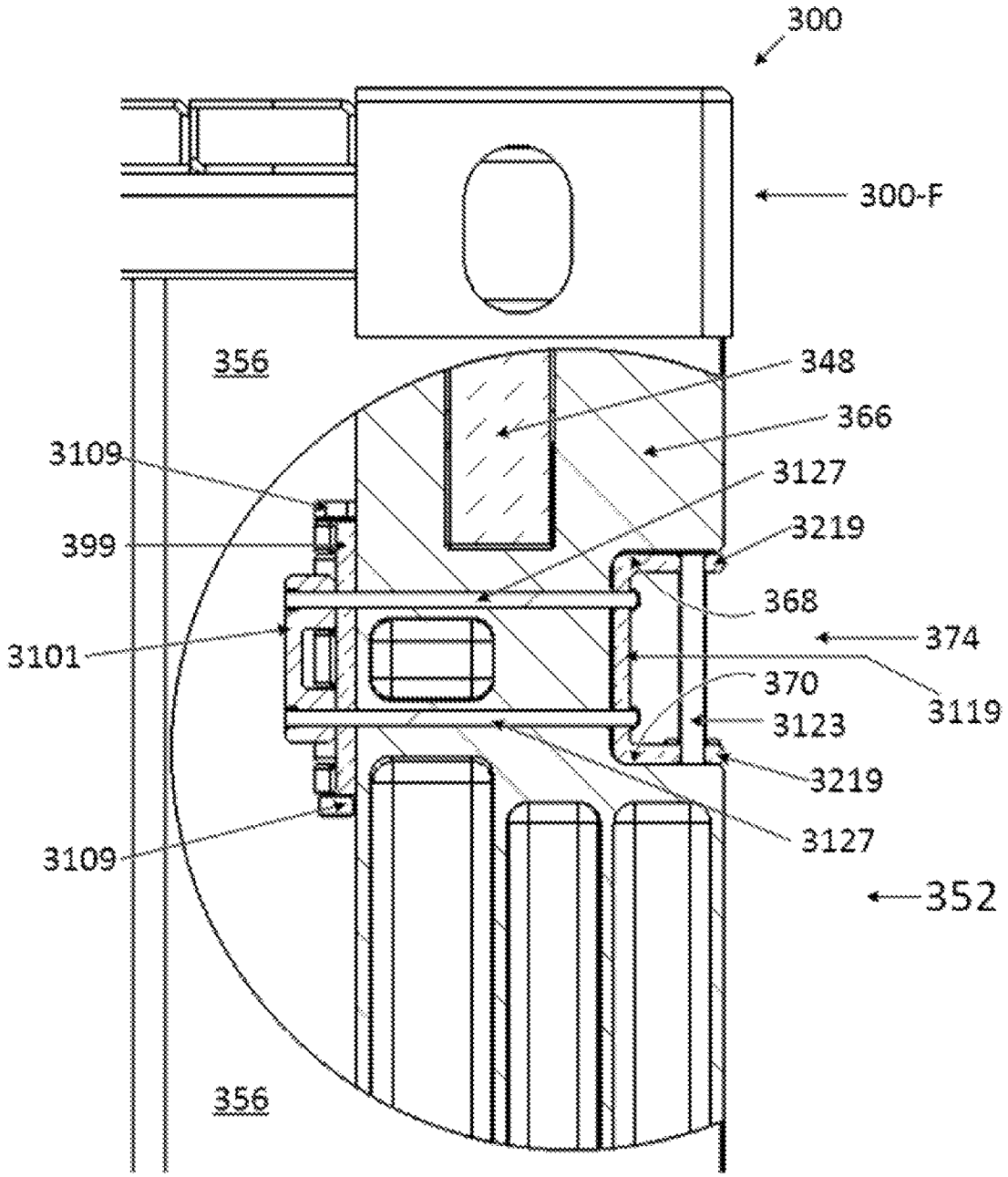
Figure 3C:
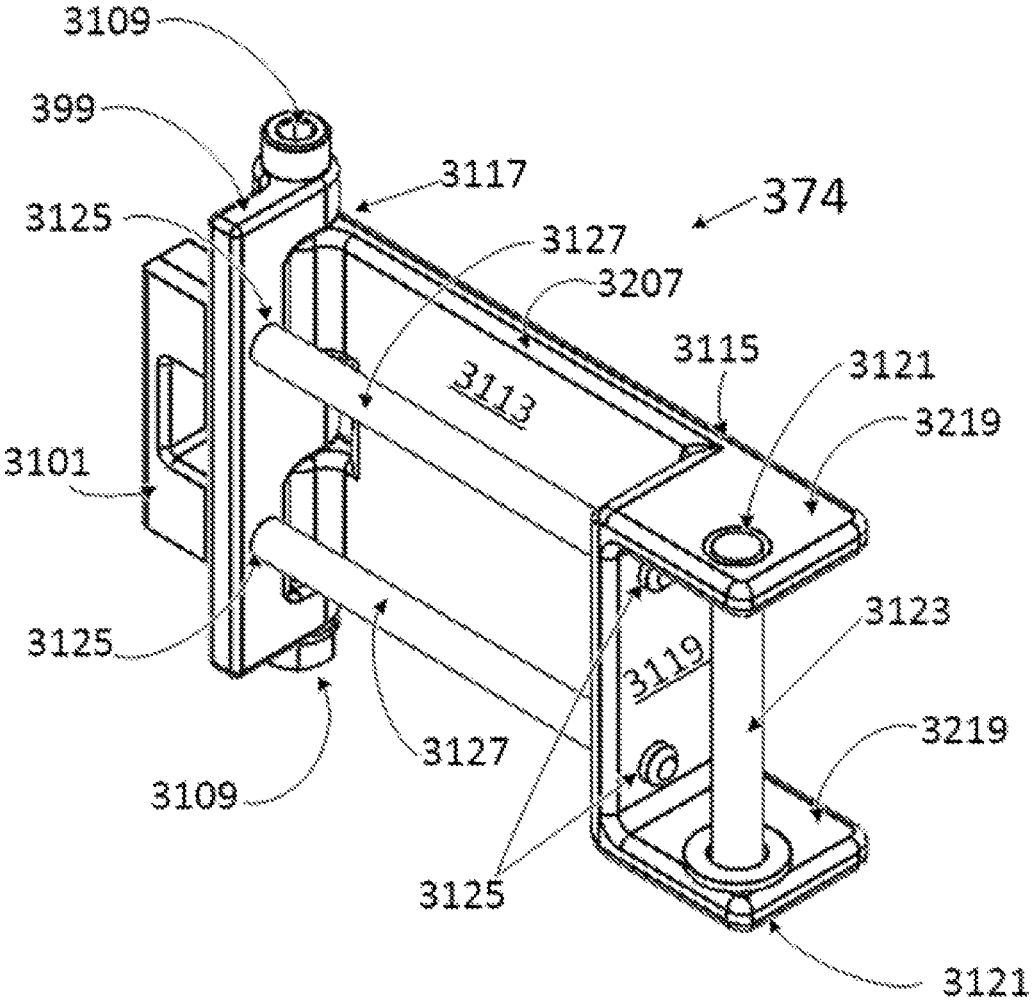

Referring now to FIGS. 3A-3C, there is shown an embodiment of the rear corner post 352 for the rear wall 284 of the freight container. FIG. 3A illustrates an exploded view of the rear corner post 352, FIG. 3B illustrates a cut-out view of the rear corner post 352 as will be discussed herein and FIG. 3C illustrates the rear door hinge 374. As seen in FIGS. 3A and 3B, the rear corner post 352 includes an elongate exterior bar 356 having a first elongate edge 358 and a second elongate edge 360 spaced apart from the first elongate edge 358, where the first elongate edge 358 and the second elongate edge 360 join a first major surface 362 and a second major surface 364 of the elongate exterior bar 356. The rear corner post 352 further includes a support beam 366 attached to the first major surface 362 of the elongate exterior bar 356. The support beam 366 and the elongate exterior bar 356 each have a first surface 368 and a second surface 370 that extend toward the first elongate edge 358 of the elongate exterior bar 356, and a third surface 372 that joins the first surface 368 and the second surface 370 to form a recess 373 to receive the rear door hinge 374 in the rear corner post 352. The support beam 366 further includes a fourth surface 376 and a fifth surface 378 extending from a first end surface 344 of the support beam 366 to a sixth surface 380 to form a corner fitting mounting block 382.

FIG. 3 also provides an illustration of corner fittings 300. As illustrated, the rear corner post 352 includes two different versions of the corner fittings 300 discussed herein. Specifically, the rear corner post 352 can include one of the corner fittings 300-G as seen in and described for FIG. 1G and includes one of the corner fitting 300-F as seen in and described for FIG. 1F. As illustrated, the receiving block 324 of each of the corner fittings 300-G and 300-F extend away from both the first side wall 314 and the second side wall 320 of the corner fittings. The receiving block 324 of each corner fittings 300-G and 300-F have an angle support portion 342 with a first end surface 344 that forms the receiving block ledge 346 with the lower surface of the receiving block 324. The receiving block 324 of corner fitting 300-F also includes the corner post mounting leg 348 that extends perpendicularly away from the second major wall 308 of the corner fitting. The angle support portion 342 is positioned on at least a portion of the first end 344 of the support beam 366 and the corner post mounting leg 348 is positioned between the corner fitting mounting block 382 and at least a portion of the elongate exterior bar 356.

The receiving block 324 of both corner fittings 300-G and 300-F include a socket 326 that can receive a bolt. Examples of the bolt include those from a bolt catch on the sill member and/or the header member, as will be discussed herein. The use of other corner fittings with the rear corner post 352, as discussed herein, is also possible.

The components of the rear corner post 352 can be formed of steel, as discussed herein (e.g., CORTEN steel), where the components can be welded (e.g., arc welding or TIG welding) together to form the rear corner post 352.

FIGS. 3B and 3C also illustrate the rear door hinge 374. As seen in FIG. 3B, the rear door hinge 374 is positioned within the recess 373 and secured (e.g., welded) to the support beam 366 of the rear corner post 352. The support beam 366 can help to protect the rear door hinge 374 from forces (e.g., stacking forces) that are transmitted through the corner post 352. Specifically, the support beam 366 can help to transmit the forces around the rear door hinge 374. The support beam 366 also serves as a seating block for the rear door hinge 374 (e.g., the rear door hinge 374 can rest in the recess 373 of the support beam 366 on one end and the other end of the support beam 366 provides an open space for a locking pin 3101, as discussed herein. As such, the support beam 366 can help to protect both the locking pin 3101 and the rear door hinge 374.

The rear door hinge 374 includes a first wing 399 and a second wing 3207, where the first wing 399 and the second wing 3207 are pivotally connected by a first hinge pin 3109. For the various embodiments, the second wing 3207 includes a first planar portion 3113 with a first end 3115 and a second end 3117 and a second planar portion 3119 that extends perpendicular from the first end 3115 of the first planar portion 3113. The first hinge pin 3109 pivotally connects the first wing 399 to the second end 3117 of the second wing 3207. As illustrated, a portion of the first planar portion 3113 of the second wing 3207 passes through an opening defined in the first wing 399 so as to allow the second end 3117 of the first planar portion 3113 of the second wing 3207 to pivotally connect to the first hinge pin 3109 and the first wing 399. The rear door hinge 374 also includes a pair of hinge lugs 3219 that extend from the second planar portion 3119 of the second wing 3207. Each of the hinge lugs 3219 has a first set of surfaces defining openings 3121 through which a second hinge pin 3123 passes. The second hinge pin 3123 is used to pivotally mount one of the first rear wall door or the second rear wall door to the rear corner post 352. The first wing 399 and the second planar portion 3119 of the second wing 3207 also include a surface 3125 that defines an opening through which the shafts 3127 of the locking pin 3101 reversibly travel.

As seen in FIG. 3A, the support beam 366 also include a surface 3203 that define an opening 3205 through the support beam 366. As illustrated, the support beam 366 includes two of the openings 3205 that open into each of the recesses 373. The openings 3205 are sized to receive and reversibly pass at least the shafts 3127 of the locking pin 3101. The locking pin 3101 is used to releasably lock a second wing 3207 of the rear door hinge 374 to both the rear corner post 352 and the support beam 366. The locking pin 3101 is manipulated from the inside of the freight container.

The shafts 3127 of the locking pin 3101 can be positioned through the openings 3205 so as to releasably lock the second wing 3207 of the rear door hinge 374 to both the rear corner post 352 and the support beam 366, and removed from the openings 3205 so as to unlock the second wing 3207 of the rear door hinge 374 from both the rear corner post 352 and the support beam 366. Specifically, the shafts 3127 of the locking pin 3101 can be removed from the openings 3205 so as to release the second wing 3207 of the rear door hinge 374 from the rear corner post 352 and the support beam 366. Once released, the second wing 3207 can rotate around first hinge pin 3109 to allow the first rear wall door and/or the second rear wall door to travel into the volume of the freight container, as discussed herein. To lock the second wing 3207 to the rear corner post 352 and the support beam 366, the shafts 3127 of the locking pin 3101 are aligned and reinserted though the openings 3205 of the rear corner post 352 and the support beam 366. When the second wing 3207 is in the locked position the first rear wall door and/or the second rear wall door can pivot on the second hinge pin 3123 to move the doors towards the exterior surface of the sidewall structures of the freight container. As discussed herein, the first wing 399 can be fastened to the support beam 366 by a welding (e.g., arc-welding) process.

Figure 4A:
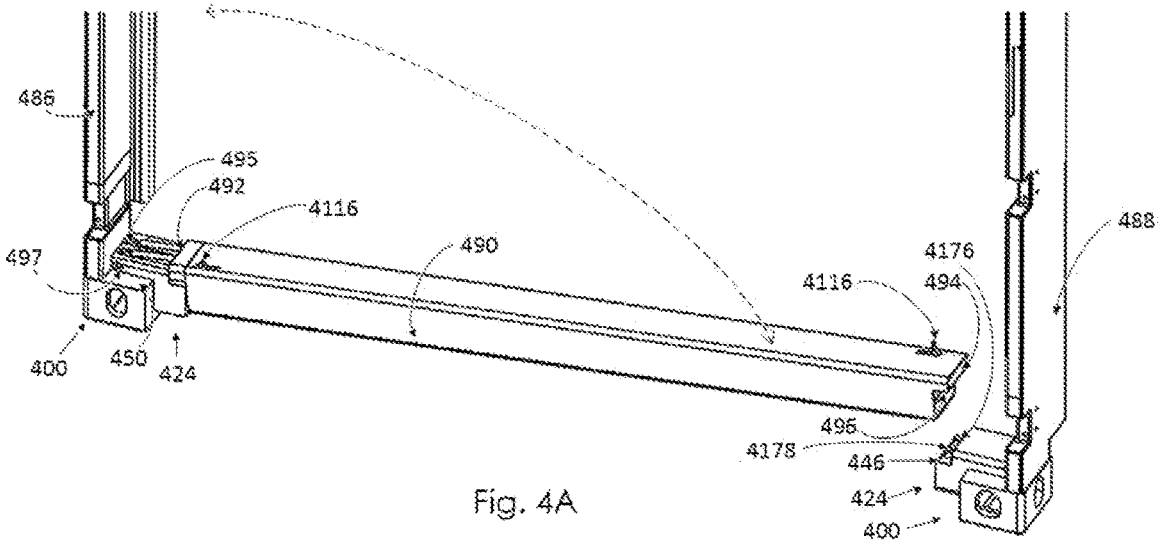
FIGS. 4A and 4B provide a perspective view of a sill member (FIG. 4A) and a header member (FIG. 4B) according to the present disclosure.
Figure 4B:
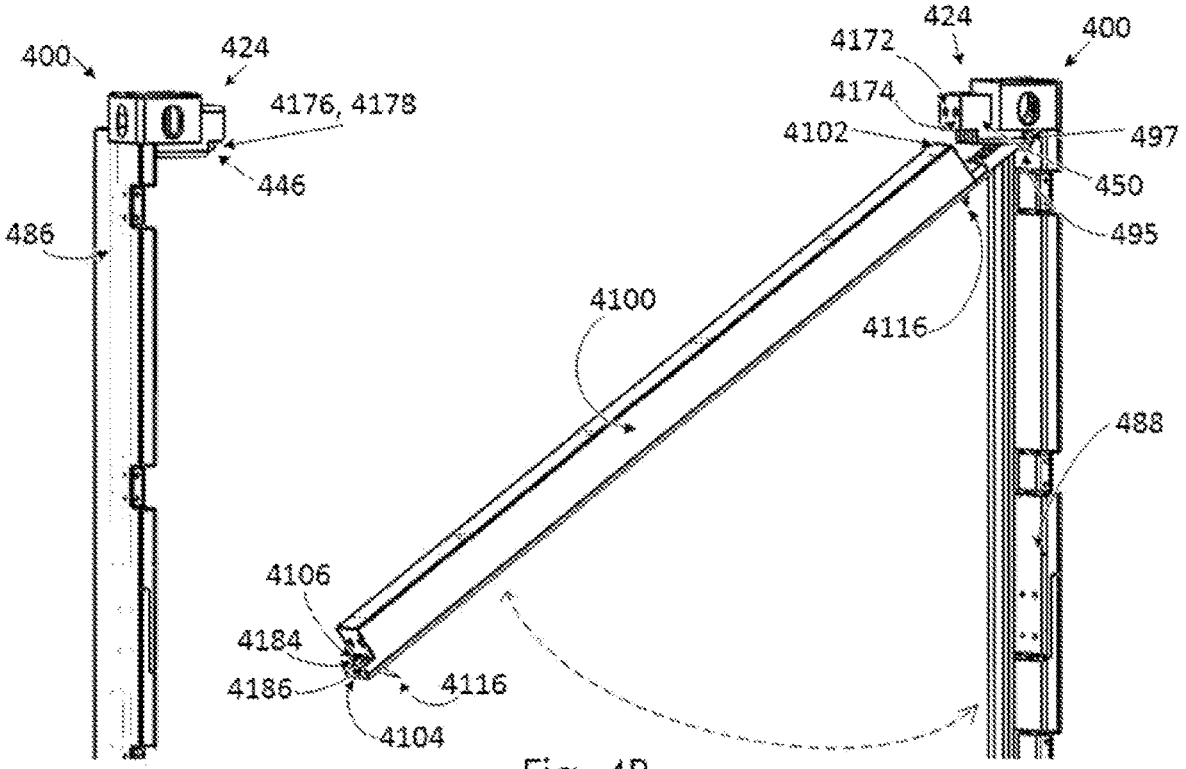

Referring now to FIGS. 4A and 4B, there is shown an embodiment of the sill member 490 and the header member 4100. FIG. 4A illustrates the sill member 490 having a first end 492, a second end 494 opposite from the first end 492. The sill member 490 further includes a hinge portion 495, where the hinge portion 495 connects the first end 492 of the sill member 490 to the first rear corner post 486 through the member hinge 450 to allow the sill member 490 to move relative the first rear corner post and the second rear corner post as illustrated in FIGS. 2A and 2B.

The second end 494 of the sill member 490 further includes a sill ledge 496 that can seat against the receiving block ledge 446 of the corner fitting 400 to create an elongate planar sill surface that is substantially parallel with the first end of the support beam of the first rear corner post 486 and the second rear corner post 488. The hinge portion 495 of the sill member 490 connects with the corner fitting 400 at the member hinge 450 with a pin 497 to allow the sill member 490 to mover (e.g., pivot) relative the first rear corner post 486 and the second rear corner post 488.

FIG. 4B illustrates the header member 4100 having a first end 4102, a second end 4104 opposite from the first end 4102. The header member 4100 also includes hinge portion 495, where the hinge portion 495 connects the first end 4102 of the header member 4100 to the second rear corner post 488 through the member hinge 450 to allow the header member 4100 to move relative the first rear corner post 486 and the second rear corner post 488 as illustrated in FIGS. 2A and 2B.

The second end 4104 of the header member 4100 further includes a header ledge 4106 that can seat against the receiving block ledge 446 of the corner fitting 400 to create an elongate planar header surface that is substantially parallel with the first end of the support beam of the first rear corner post 486 and the second rear corner post 488. The hinge portion 495 of the header member 4100 connects with the corner fitting 400 at the member hinge 450 with a pin 497 to allow the header member 4100 to mover (e.g., pivot) relative the first rear corner post 486 and the second rear corner post 488.

FIGS. 4A and 4B also show the sill member 490 and the header member 4100 further including a bolt catch 4116 to lock and unlock the sill member 490 to the first rear corner post 486 and the header member 4100 to the second rear corner post 488. Referring to FIGS. 5A-5E, there is shown in more detail the bolt catch 5116 that is used to lock and unlock the sill member 490 to the first rear corner post 486 and to lock and unlock the header member 4100 to the second rear corner post 488.

Figure 5A:
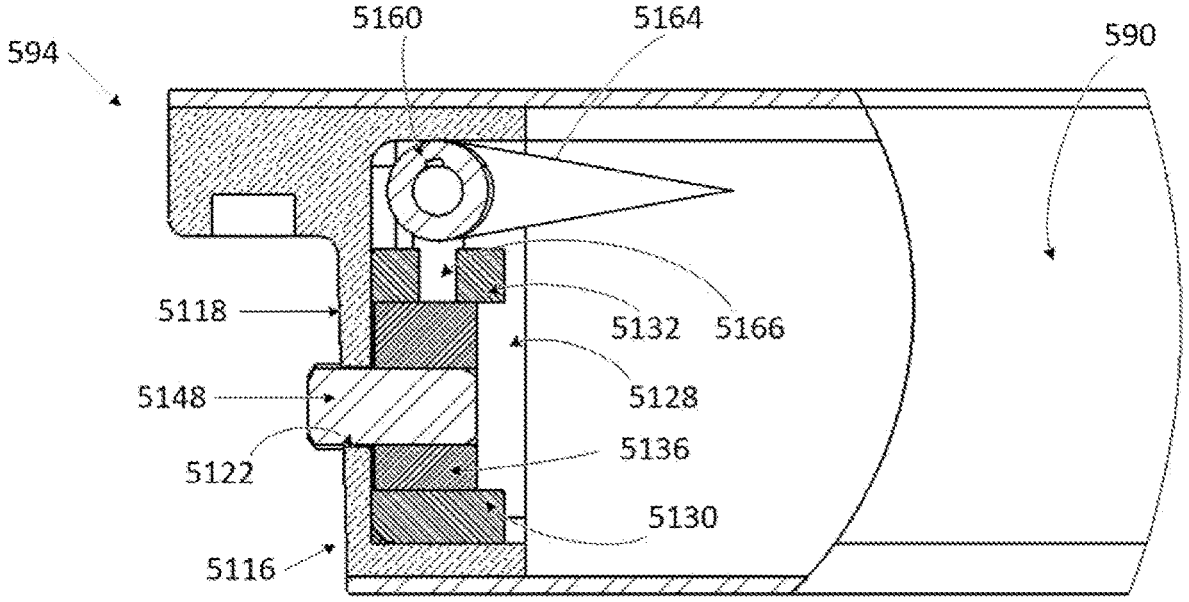
FIGS. 5A-5E provides views of a bolt catch according to the present disclosure.
Figure 5B:
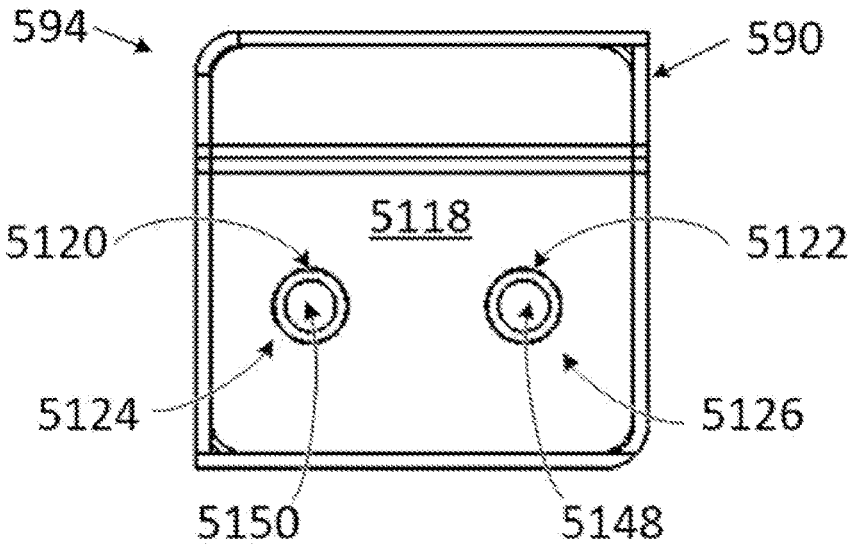
Figure 5C:
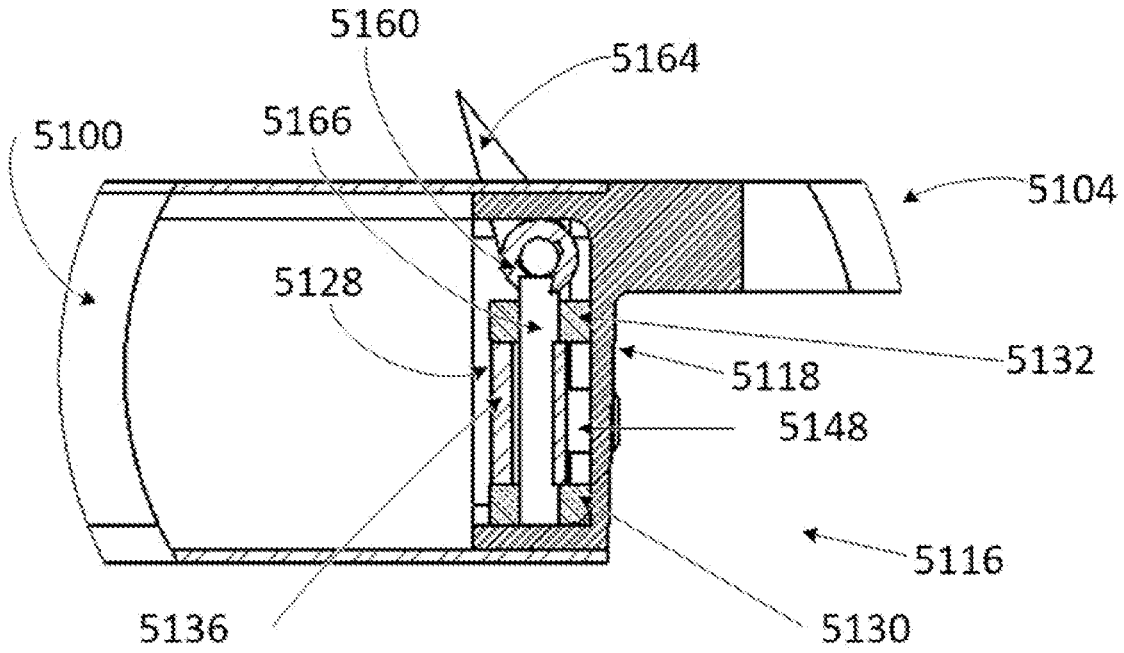
Figure 5D:
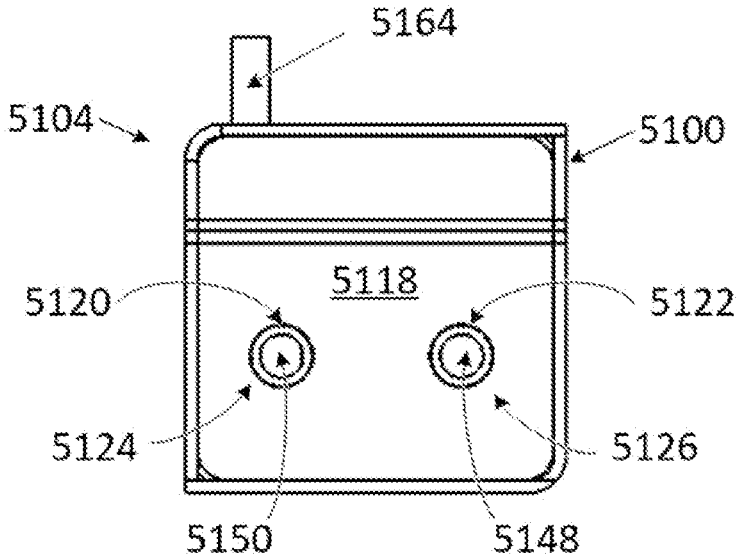
Figure 5E:
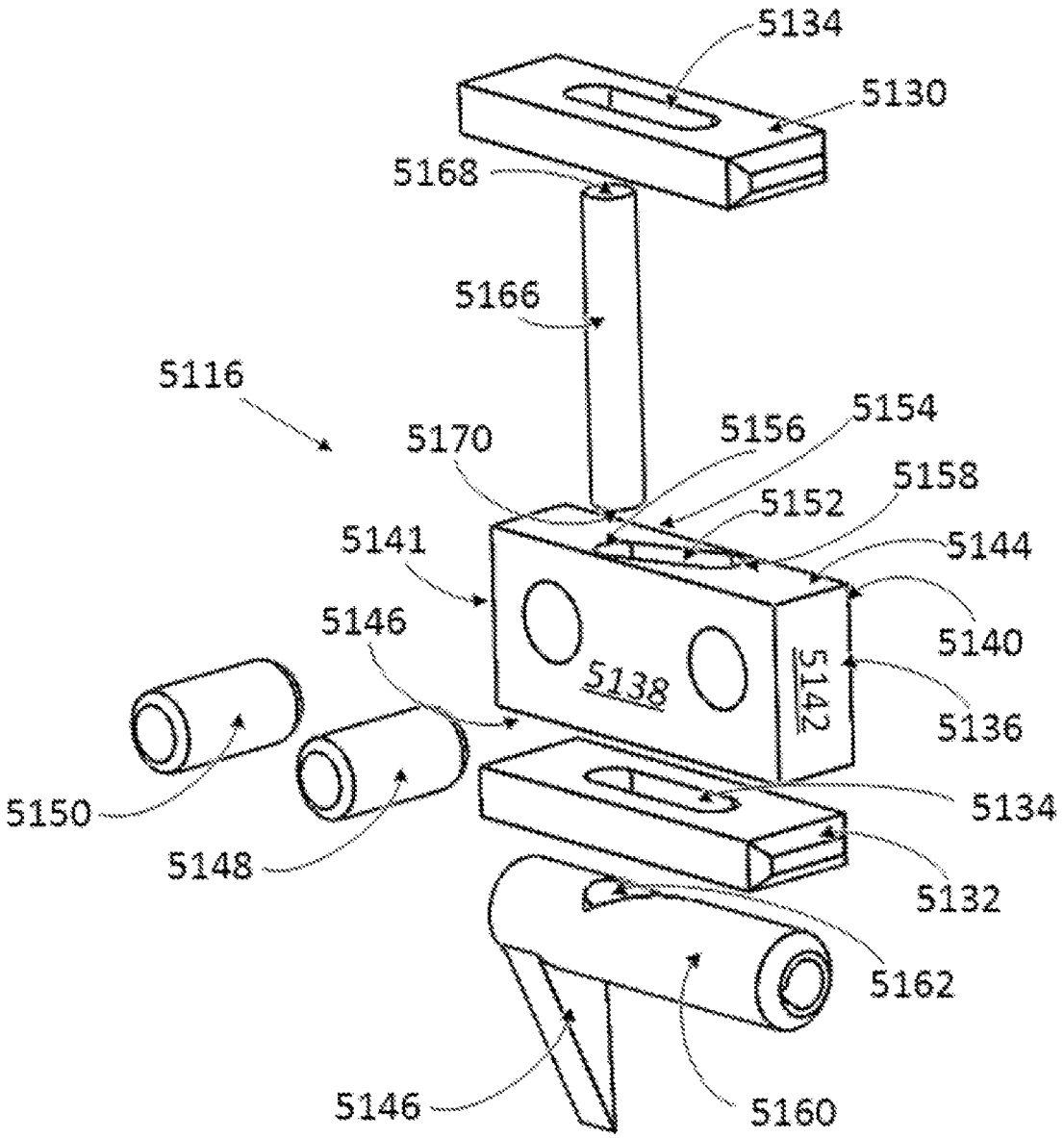

The bolt catch 5116 is used in both the sill member 590 (FIGS. 5A and 5B) and the header member 5100 (FIGS. 5C and 5D), where both structure independently include the same structures used to form the bolt catch 5116. So, as illustrated in FIGS. 5A and 5B the second end 594 of the sill member 590 includes an end face 5118 having a first surface 5120 and a second surface 5122 that define a first opening 5124 and a second opening 5126, respectively, through the second end 594 of the sill member 590 to a bolt catch housing 5128 in the second end 594 of the sill member 590. In similar fashion, FIGS. 5C and 5C provides a view of the bolt catch 5116 in which the second end 5104 of the header member 5100 also includes an end face 5118 having a first surface 5120 and a second surface 5122 that define a first opening 5124 and a second opening 5126, respectively, through the second end 5104 of the header member 5100 to a bolt catch housing 5128 in the second end 5104 of the header member 5100. In other words, the second end 594, 5104 of each of the sill member 590 and the header member 5100 includes the end face 5118 having a first surface 5120 and a second surface 5122 that define a first opening 5124 and a second opening 5126, respectively, through the second end 594, 5104 of each of the sill member 590 and the header member 5100 to a bolt catch housing 5128 in each of the second end 594 of the sill member 590 and the second end 5104 of the header member 5100.

The bolt catch housing 5128 in both the sill member 590 and the header member 5100 contains (includes inside the bolt catch housing 5128) a first guide block 5130 and a second guide block 5132 each having an elongate guide slot 5134. A moveable dowel block 5136 is positioned between the first guide block 5130 and the second guide block 5132, where the moveable dowel block 5136 is a rectangular cuboid having a first major surface 5138 and a second major surface 5140 opposite the first major surface 5138; a first end surface 5141 and a second end surface 5142 opposite the first end surface 5141; a top surface 5144 and a bottom surface 5146 opposite the top surface 5144. The bolt catch 5116 further includes a first bolt 5148 and a second bolt 5150 that extend away from the first major surface 5138, the first bolt 5148 and the second bolt 5150 being spaced apart from each other. The first bolt 5148 is at least partially positioned through the first opening 5124 in the end face 5118 and the second bolt 5150 is at least partially positioned through the second opening 5126 in the end face 5118.

The moveable dowel block 5136 further includes a guide surface 5152 that forms an elongate drive slot 5154 through the top surface 5144 and the bottom surface 5146 of the moveable dowel block 5136. The elongate drive slot 5154 extends between the first end surface 5141 and the second end surface 5142 with a first end 5156 of the elongate drive slot 5154 being closer to the first major surface 5138 than the second major surface 5140, and a second end 5158 the elongate drive slot 5154 being closer to the second major surface 5140 than the first major surface 5138.

The bolt catch 5116 further includes an elongate cam keeper 5160 having a helical guide slot 5162. The elongate cam keeper 5160 is rotatably mounted in the bolt catch housing 1128 (e.g., through the use of an axle), where a handle 5164 extending from the elongate cam keeper 5160 allows the user to rotate the elongate cam keeper 5160 in the bolt catch housing 5128. Finally, the bolt catch 5116 includes a drive pin 5166 having a first end 5168 and a second end 5170. The drive pin 5166 passes from the elongate guide slot 5134 of the first guide block 5130 through the elongate drive slot 5154 of the moveable dowel block 5136 and the elongate guide slot 5134 of the second guide block 5132 to position the second end 5170 of the drive pin 5166 in the helical guide slot 5162 of the elongate cam keeper 5160.

Rotating the handle 5164 extending from the elongate cam keeper 5160 in a first direction causes the moveable dowel block 5136 to move the first bolt 1148 and the second bolt 5150 through the first opening 5124 and the second opening 5126, respectively, so that at least a portion of the first bolt 5148 and the second bolt 1150 extend beyond the end face 5118 (e.g., FIG. 5A). Rotating the handle 5164 extending from the elongate cam keeper 5160 in a second direction opposite the first direction causes the moveable dowel block 5136 to retract at least a portion of the first bolt 5148 and the second bolt 5150 through the first opening 5124 and the second opening 5126, respectively (e.g., FIG. 5B).

Referring again to FIGS. 4A and 4B, a bolt catch 4116 is shown located at each of the first end 492 and the second end 494 of the sill member 490, and at each of the first end 4102 and the second end 4104 of the header member 4100. In addition, the receiving block 424 for each of the corner fittings 400 in FIGS. 4A and 4B further include a first socket 4172 and a second socket 4174 (best seen in FIG. 4B) that receives the first bolt 4148 and the second bolt 4150 of the bolt catch 4116. As discussed herein, the receiving block ledge 446 of the corner fitting 400 can also include a first bolt 4176 and a second bolt 4178 separate from the first bolt 4176, where the first bolt 4176 and the second bolt 4178 extend from the receiving block ledge 446. For FIG. 4A, the sill ledge 496 includes a first socket and a second socket to receive the first bolt 4176 and the second bolt 4178 when the sill ledge 496 seats against the receiving block ledge 446 of the corner fitting 400 to create the elongate planar sill surface that is substantially parallel with the first end of the support beam of the first rear corner post 186 and the second rear corner post 188. For FIG. 4B, the header ledge 4106 includes a first socket 4184 and a second socket 4186 to receive the first bolt 4176 and the second bolt 4178 when the header ledge 4106 seats against the receiving block ledge 446 of the corner fittings 400 to create the elongate planar header surface 4108 that is substantially parallel with the first end 465 of the support beam 466 of the first rear corner post 486 and the second rear corner post 488.

Figure 6A:
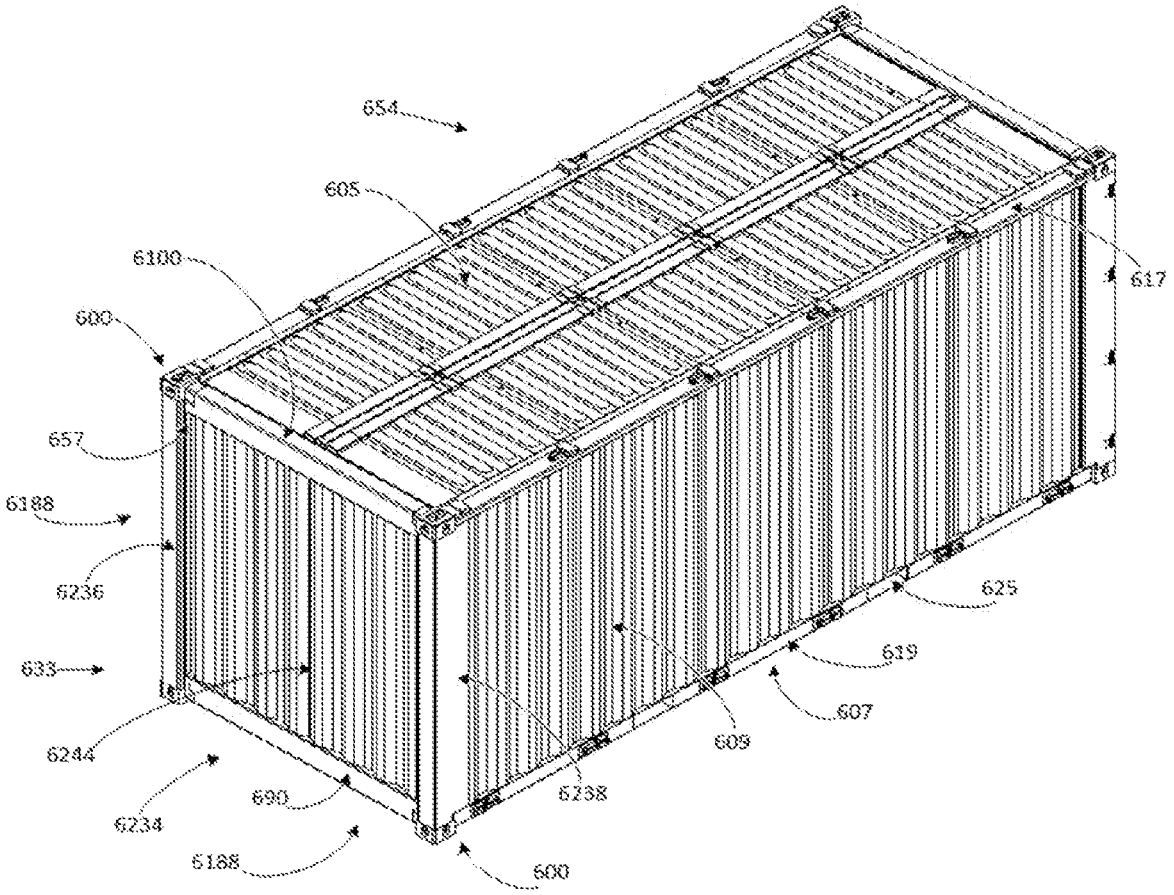
FIGS. 6A and 6B provides a perspective view of a front wall of a freight container according to the present disclosure.
Figure 6B:
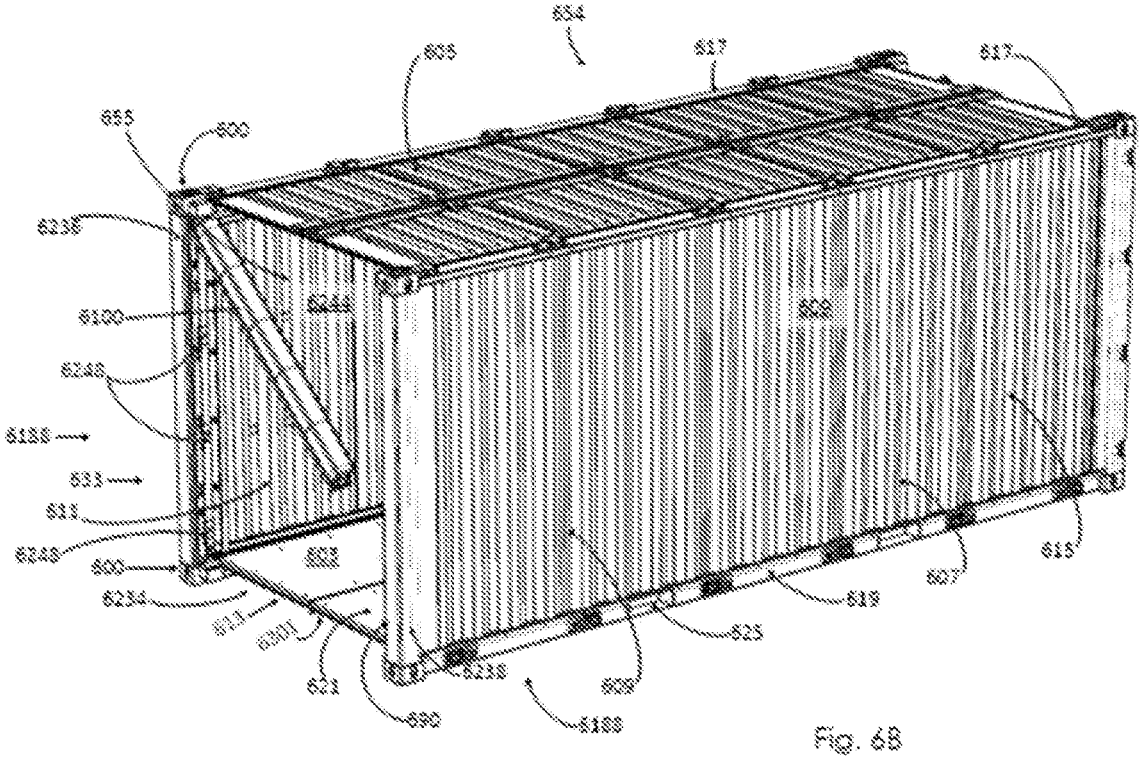

Referring now to FIGS. 6A and 6B, there is shown a perspective view of a front wall 6234 of a freight container 654 according to the present disclosure. As illustrated, the freight container 654 includes a floor structure 603 (FIG. 6B), a roof structure 605 opposite the floor structure 603, and a sidewall structure 607 that joins the floor structure 603 and the roof structure 605. Each of the sidewall structures 607 has an exterior surface 609 and an interior surface 611 (FIG. 6B), where the interior surface 611 of the sidewall structures 607, the floor structure 603 and the roof structure 605 at least partially defines a volume 613 (FIG. 6B) of the freight container 654.

The sidewall structure 607 includes a sidewall panel 615 that is joined to an upper side rail 617 and a bottom side rail 619. The floor structure 603 (FIG. 6B) includes flooring 621 (FIG. 6B) that is attached to cross members 6301, where the cross members 6301 are joined to the bottom side rail 619. The bottom side rail 619 can further include forklift pockets 625.

As illustrated, the front wall 6234 of the freight container 654 is joined with the roof structure 605, the floor structure 603 and the sidewall structures 607. The front wall 6234 includes two of a front corner post 6188 (a first front corner post 6236 and a second front corner post 6238), a front door hinge 6248, a corner fitting 600, a sill member 690, a header member 6100 and a front wall door 6244. The first front corner post 6236 and the second front corner post 6238 extend between and join to the sill member 690 and the header member 6100 through the corner fittings 600 to form a front end frame 633. FIG. 6A illustrates the front end frame 633 having both the sill member 690 and the header member 6100 in their closed and locked state (as will be discussed more fully herein), while FIG. 6B illustrates the front end frame 633 having both the sill member 690 and the header member 6100 in their unlocked and open state (as will be discussed more fully herein).

The front wall door 6244 is attached to the first front corner post 6236 with two or more of the front door hinges 6248. The front wall door 6244 has a height and a width that allows the front wall door 6244 to fit within an area 655 (FIG. 6B) defined by the front end frame 633. The front wall door 6244 can pivot on the front door hinges 6248 into the volume 613 of the freight container 654 and extend adjacent the interior surface of the sidewall structure (as seen in FIG. 6B). The front wall door 6244 can further include a gasket 657 around its perimeter to help provide weatherproofing on the exterior portion of the front wall 6234. Further details regarding the front wall can also be found in co-pending U.S. patent application Ser. No. 14/238,893 entitled "Reversibly Foldable Freight Container," which is incorporated herein by reference in its entirety.

Figure 7A:
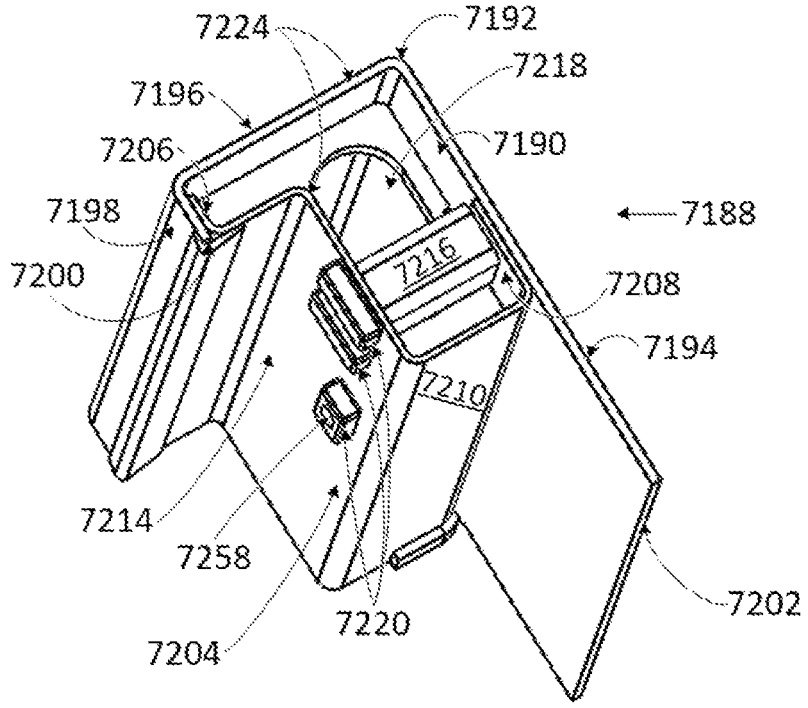
FIGS. 7A-7F provide views of a front corner post (FIGS. 7A-7C) and a front wall (FIGS. 7D-7F) of a freight container according to the present disclosure.
Figure 7B:
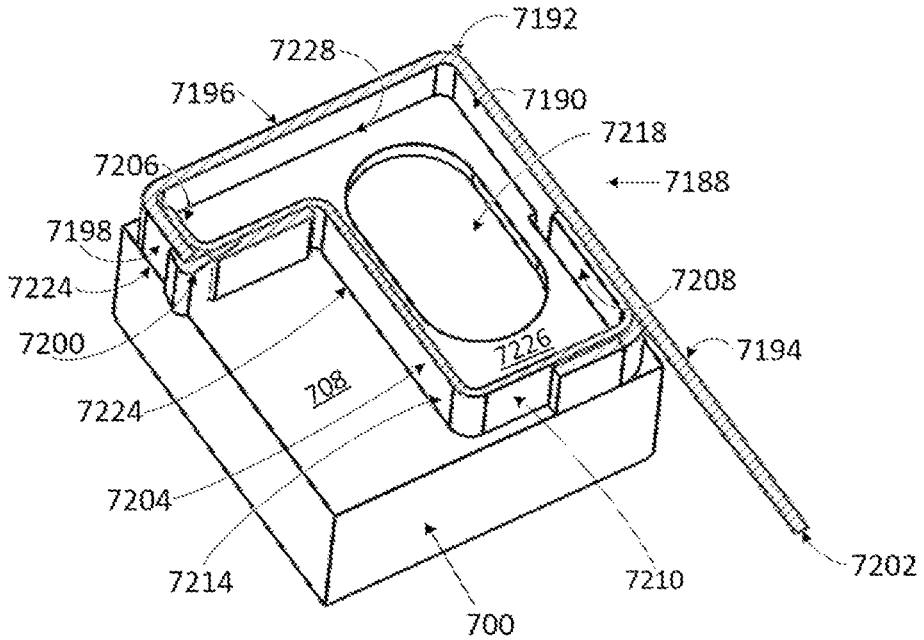
Figure 7C:
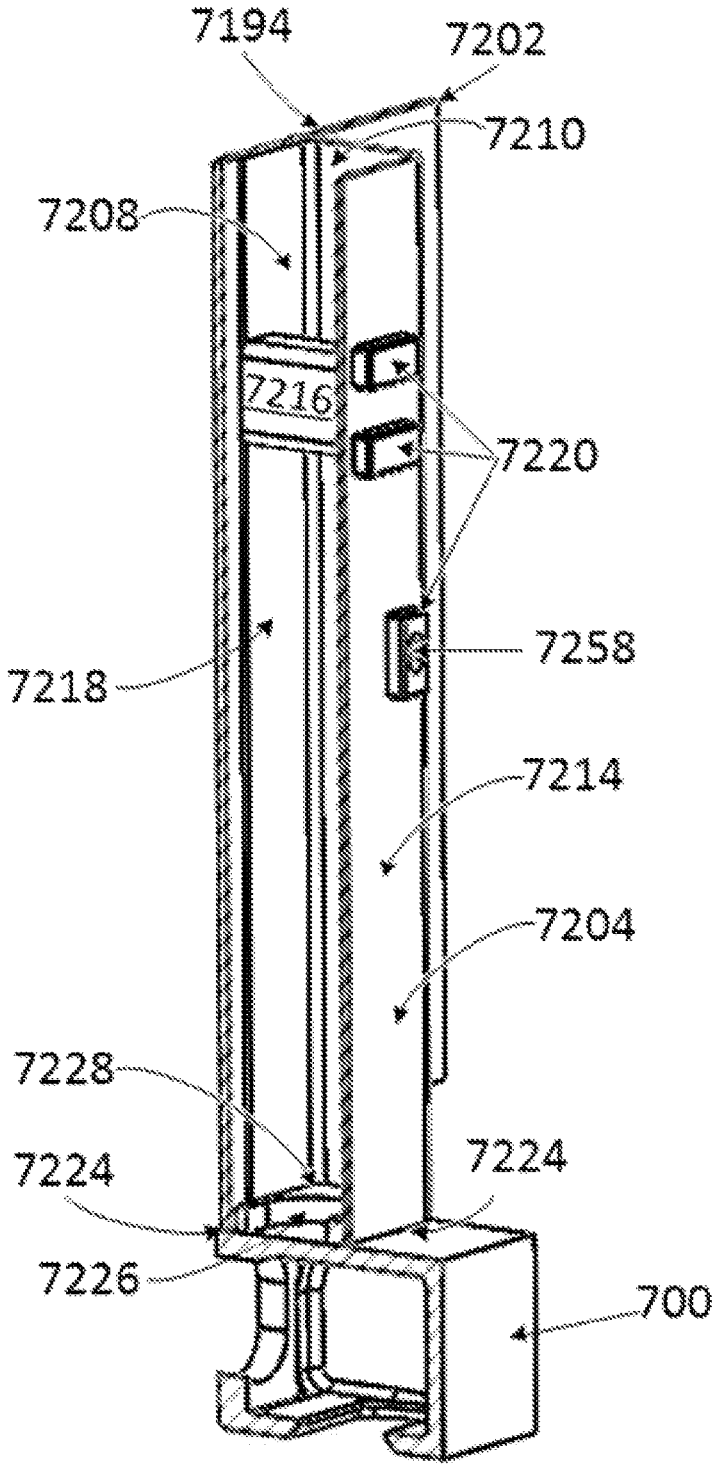
Figure 7D:
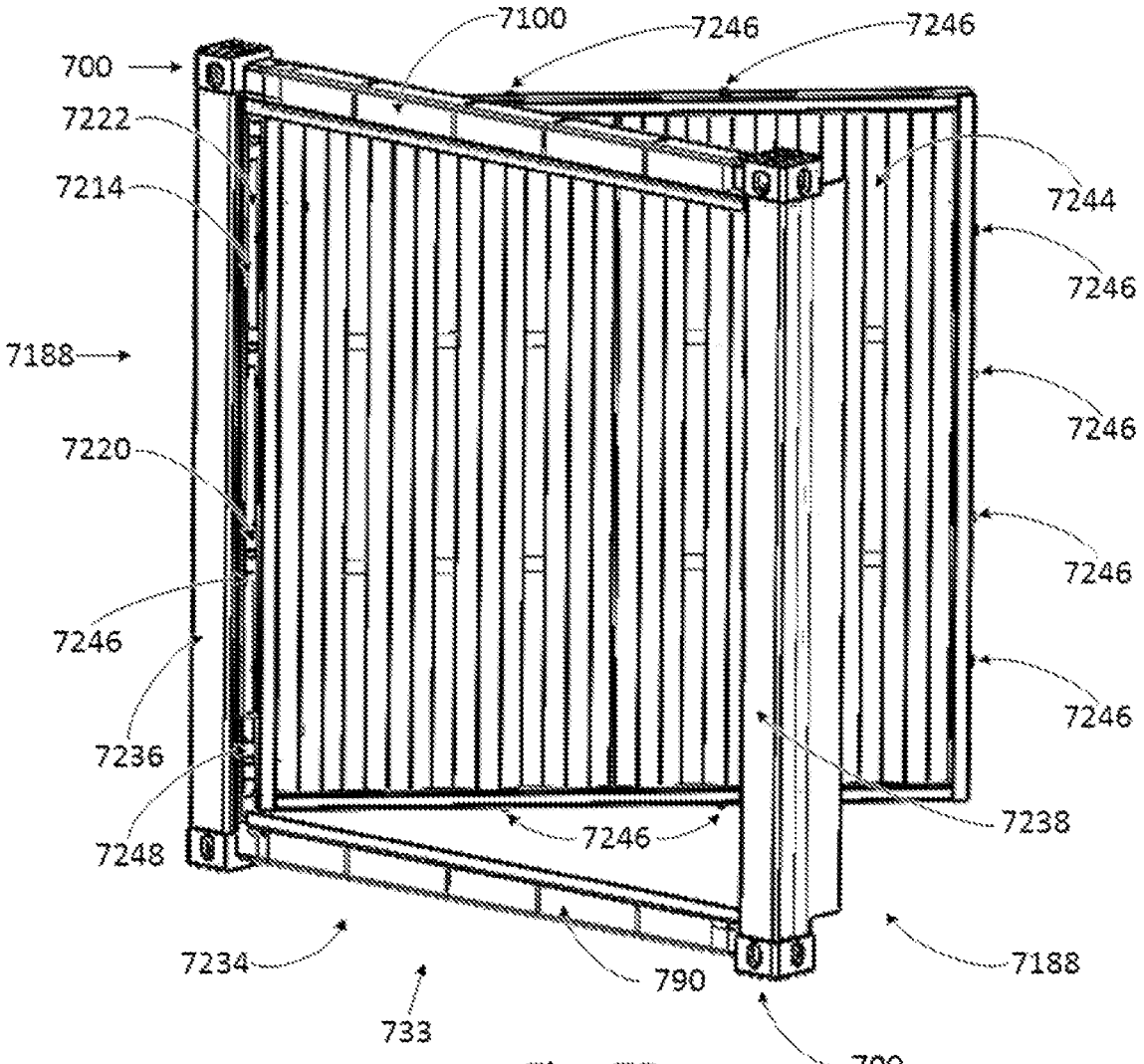
Figure 7E:
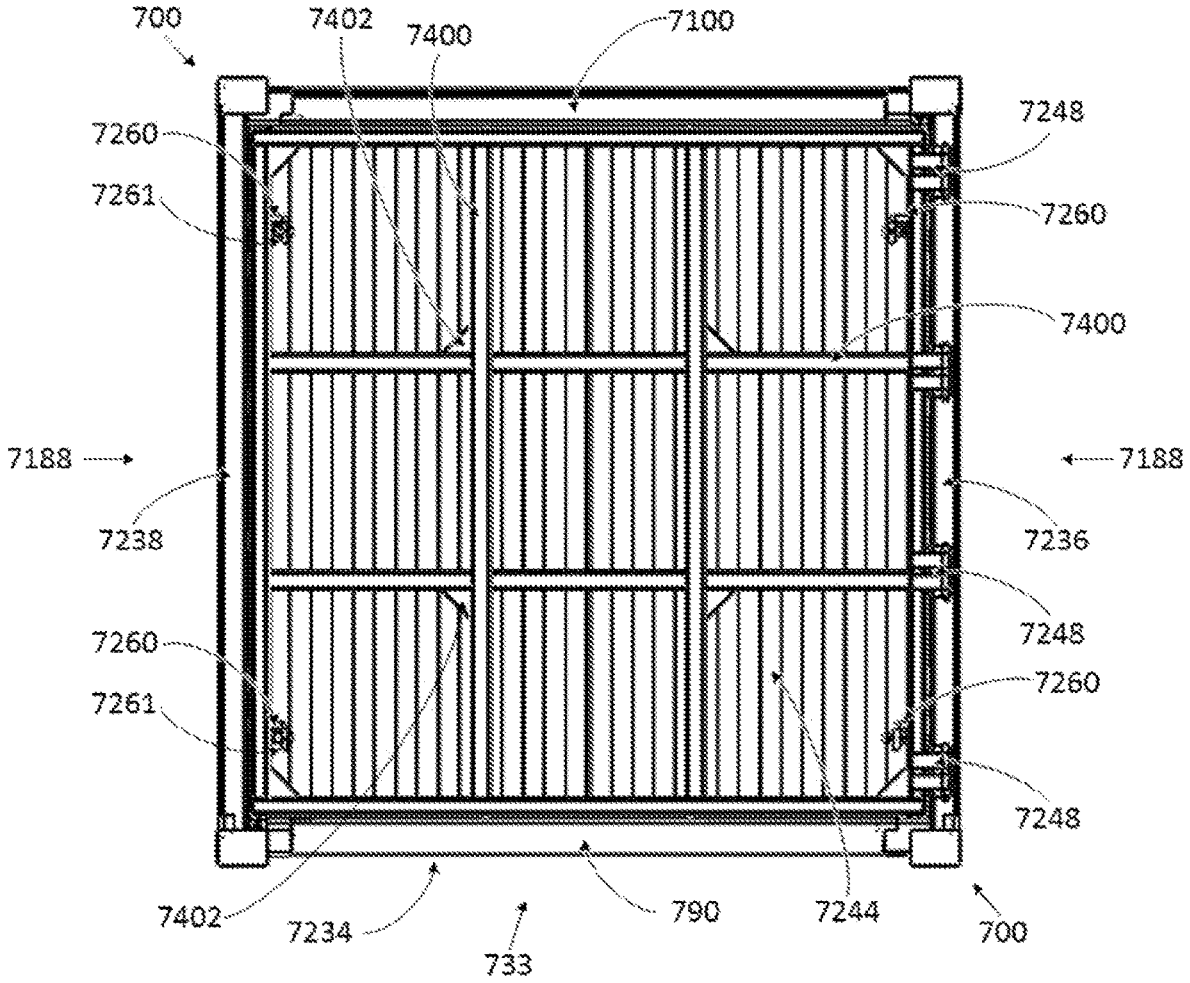
Figure 7F:
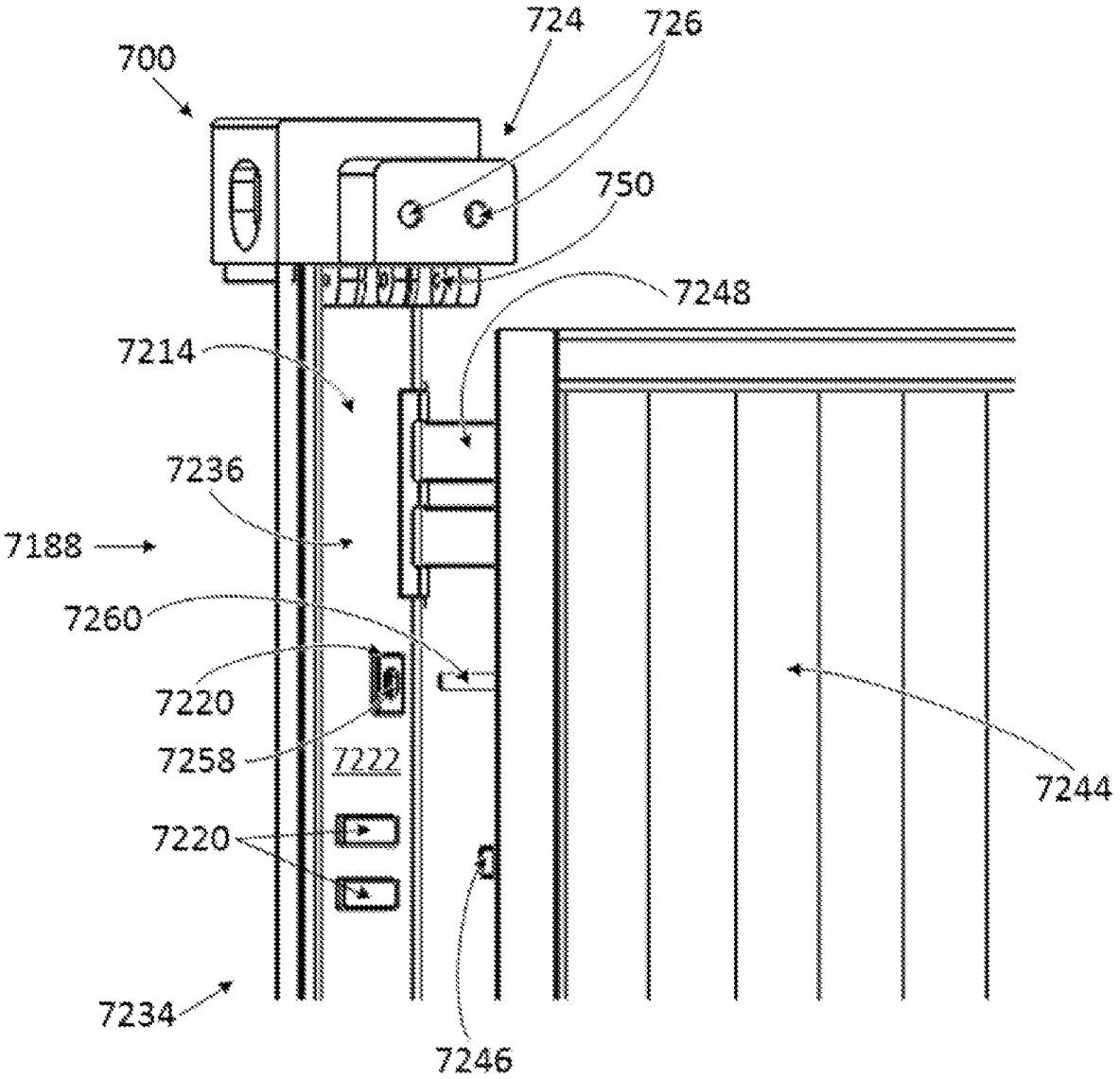

Referring now to FIG. 7A-7F there is shown an embodiment of the front wall 7234 with the front corner post 7188 of the freight container. FIGS. 7A-7C provide various sectional views of the front corner post 7188, while FIGS. 7D-7F provide various perspective views of the front wall 7234 from both an exterior position (FIG. 7D seen from outside the freight container) and FIG. 7E provides a plan view of the front wall 7234 from an interior position (seen from inside the freight container).

As seen in FIG. 7A, the front corner post 7188 includes an elongate exterior corner bar 7190 having an outer corner 7192 extending between a first exterior wall 7194 and a second exterior wall 7196. The elongate exterior corner bar 7190 further includes a first extension wall 7198 parallel with the first exterior wall 7194 and projecting perpendicularly away from the second exterior wall 7196 to a first elongate edge 7200, and a second elongate edge 7202 spaced apart from the first elongate edge 7200. The first elongate edge 7200 and the second elongate edge 7202 generally face the same direction.

The front corner post 7188 further includes an elongate interior corner bar 7204. The elongate interior corner bar 7204 includes a first portion 7206 parallel with and joined to the first extension wall 7198 (e.g., welded together) of the elongate exterior corner bar 7190 and a second portion 7208 parallel with and joined to the first exterior wall 7194. The elongate interior corner bar 7204 further includes a first interior wall 7210 extending from the second portion 7208, where the first interior wall 7210 is parallel with the second exterior wall 7196 of the elongate exterior corner bar 7190. The elongate interior corner bar 7204 additionally has a second interior wall 7212 extending from the first portion 7206, the second interior wall 7212 being parallel with the first interior wall 7210, and a door interface wall 7214 parallel with the first exterior wall 7194. The door interface wall 7214 connects the first interior wall 7210 and the second interior wall 7212 of the elongate interior corner bar 7204.

The front corner post 7188 further includes a gusset 7216 extending across an enclosed area 7218 defined by the elongate exterior corner bar 7190 and the elongate interior corner bar 7204. As illustrated, the gusset 7216 is illustrated having a tubular configuration. Other shapes for the gusset 7216 are possible. For example, the gusset 7216 can be a bar having a rectangular cross section, among other shapes. The front corner post 7188 further includes an anti-racking block 7220 on a surface 7222 of the door interface wall 7214 opposite the gusset 7216. The anti-racking block 7220 on the surface 7222 of the door interface wall 7214 opposite the gusset 7216 can further include a surface defining an opening 7258 through at least one of the anti-racking blocks 7220.

The elongate exterior corner bar 7190 and the elongate interior corner bar 7204 of the front corner post 7188 each have an end 7224, where the front corner post 7188 further includes an additional embodiment of a corner fitting 700 on the end 7224 of the elongate exterior corner bar 7190 and the elongate interior corner bar 7204. As illustrated, the corner fitting 700 includes the structures discussed above for FIGS. 1A-1C. In addition, the corner fitting 700 illustrated in FIG. 7A includes a corner post insert 7226 extending from the second major wall 708, where the corner post insert 7226 fits into the enclosed area 7218 defined by the elongate exterior corner bar 7190 and the elongate interior corner bar 7204 with a peripheral surface 7228 of the corner post insert 7226 seated against an interior surface of each of the first exterior wall 7194, the second exterior wall 7196, the first portion 7206 of the elongate interior corner bar 7204, the second portion 7208 of the elongate interior corner bar 7204, the first interior wall 7210 of the elongate interior corner bar 7204, the second interior wall 7212 of the elongate interior corner bar 7204 and the door interface wall 7214 of the elongate interior corner bar 7204.

As with the other embodiments of the corner fittings, the corner fitting 700 used with the front corner post 7188 can include a portion of a member hinge 750 (illustrated in FIG. 7F), as discussed herein (e.g., a knuckle). In addition, the receiving block 724 of the corner fitting 700 can include a socket 726 that can receive a bolt, as discussed herein. For the various embodiments, the socket can extend into the receiving block 724 from a lower surface of the receiving block. In addition, a bolt can extend from the lower surface of the receiving block of corner fitting 700.

Referring now to FIG. 7D-7E, there is shown at least a portion of the front wall 7234 with the front wall door 7244 attached to the first front corner post 7236 with the front door hinges 7248. As illustrated, the front door hinges 7248 allow the front wall door 7244 to swing into the volume of the freight container. The front wall door 7244 further includes a second anti-racking block 7246. The front wall door 7244 can move relative the first front corner post 7236 on the front door hinges 7248 to position the second anti-racking block 7246 adjacent (e.g., on or in-between) the anti-racking block(s) 7220 on the surface 7222 of the door interface wall 7214 opposite the gusset 7216.

The anti-racking blocks 7220 and 7246 can have an elongate configuration with a square or rectangular cross-sectional shape (as seen). The anti-racking blocks 7220 and 7246 can be welded and/or fastened (e.g., bolted or screwed) to their respective structures. When the front wall door 7244 of the freight container is closed and locked the anti-racking blocks 7220 and 7246 can help to limit the impact of racking forces the freight container. The anti-racking blocks 7220 and 7246 can also help to minimize mechanical stresses on the hinges 7248 of the front wall door 7244 of the freight container when it is closed and locked. When the front wall door 7244 is in its closed and locked configuration, the anti-racking blocks 7220 and 7246 help to maintain the relative perpendicular position of the front wall door 7244 under racking conditions (e.g., maintain their rectangular shape against the external racking forces). When racking is occurring, the anti-racking blocks 7220 and 7246 can provide "nodes" through which racking forces (e.g., lateral forces) can be transferred through the front wall door 7244.

The front wall door 7244 further includes a front door latching bolt 7260 that is used to lock and unlock the front wall door 7244 from the front end frame 733. In one embodiment, the front door latching bolt 7260 includes a latch frame 7261 mounted to an inside surface of the front wall door 7244. The latch frame 7261 guides the front door latching bolt 7260 in a lateral direction to lock and unlock the front wall door 7244 from the front end frame 733. The front door latching bolt 7260 can include a handle portion that can placed in a locked positioned in the latch frame 7261 to prevent unintended lateral movement of the front door latching bolt 7260.

In locking the front wall door 7244 to the front end frame 733 when the front wall door 1244 is in a closed position, the front door latching bolt 7260 is slid so as to extend at least a portion of the front door latching bolt 7260 through an opening in a peripheral frame of the front wall door 7244 and into the opening 7258 of the anti-racking block 7220 on the surface 7222 of the door interface wall 7214. In unlocking the front wall door 7244 from the front end frame 733, the front door latching bolt 7260 is slid so as retract the front door latching bolt 7260 from the opening 7258 of the anti-racking block 7220 on the surface 7222 of the door interface wall 7214.

FIG. 7E also illustrates the structural design of the front wall door 7244. As illustrated, the front wall door 7244 includes structural member 7400 (e.g., tubular members) that allow the front wall door 7244 to act as a stiffener to aid in anti-racking. As illustrated, the front wall door 7244 includes structural members 7400 in a crossing configuration with internal gussets 7402 at the intersections of the structural members 7400 that help to maintain the shape and structure of the front wall door 7244. The structural members 7400 along with the anti-racking blocks 7220 around the perimeter of the door allow the front end wall to be a continuous fixed structure that allows the front wall door 7244 to aid with the anti-racking stresses. The presence of the structural members 7400 also allows a portion of the corrugated panel between the structural members 7400 to be removed to create an opening (e.g., a window or a door) through the end wall without diminishing its strength.

The front wall 7234 further includes the sill member 790 and the header member 7100 each having a bolt catch 7116, as discussed herein, to lock and unlock the sill member 790 to the first front corner post 7236 and the header member 7100 to the second front corner post 7238. A detailed discussion of the sill member and the header member each having the bolt catch was presented herein (e.g., for FIGS. 4A-5E). In addition, a detailed description of the corner fittings and the member hinge in relation to the each of the sill member and the header member each with the bolt catch has also been presented herein (e.g., for FIGS. 4A-5E). This detailed discussion applies equally to the sill member 790 and the header member 7100, each having a bolt catch 7116, and the corner fittings 700 of the front wall 7234, and so such a discussion will not be repeated, but is incorporated in its entirety at this point.

The components of the freight container provided herein can be formed of materials suitable for and built so as to comply with ISO standard 1496-1 (fifth edition 1990-08-15) and its amendments, which are all incorporated herein by reference in its entirety. For the various embodiments, the components of the freight container can be formed of steel. Examples of such steel include, but are not limited to, 'weathering steel' as specified within standard BS EN 10025-5:2004, which is also known as CORTEN steel. For the various embodiments, the floor of the freight container can be made of planking wood or plywood.

Although specific examples have been illustrated and described herein, those of ordinary skill in the art will appreciate that an arrangement calculated to achieve the same results can be substituted for the specific examples shown. This disclosure is intended to cover adaptations or variations of one or more examples of the present disclosure. It is to be understood that the above description has been made in an illustrative fashion, and not a restrictive one. Combination of the above examples, and other examples not specifically described herein will be apparent to those of skill in the art upon reviewing the above description.

What is claimed:

1. A corner fitting for a freight container, comprising:

a first major wall having a surface defining an opening through the first major wall;

a second major wall spaced apart from and parallel with the first major wall;

a first end wall perpendicular to and extending between the first major wall and the second major wall;

a second end wall perpendicular to and extending between the first major wall and the second major wall, and spaced apart from and parallel with the first end wall;

a first side wall perpendicular to and extending between the first major wall and the second major wall, and perpendicular to and extending between the first end wall and the second end wall, where the first side wall includes a surface defining an opening through the first side wall;

a second side wall perpendicular to and extending between the first major wall and the second major wall, perpendicular to and extending between the first end wall and the second end wall and that is spaced apart from and parallel with the first side wall, where the first major wall, the second major wall, the first end wall, the second end wall, the first side wall and the second side wall define a volume that can receive a cone of a twistlock;

a receiving block that extends away from both the first side wall and the second side wall, the receiving block having a socket that can receive a bolt;

where the receiving block further includes a lower surface parallel with the second major wall and where a bolt extends from the lower surface of the receiving block;

where the receiving block includes a bolt receiving surface parallel with the second side wall and perpendicular to the lower surface of the receiving block, the bolt receiving surface having a first bolt socket and a second bolt socket spaced apart from the first bolt socket, where the first bolt socket and the second bolt socket extend into the receiving block towards the second side wall; and where the receiving block further includes an angle support portion having a first end surface that forms a receiving block ledge with the lower surface and a corner post mounting leg that extends perpendicularly away from the second major wall of the corner fittings.

2. The corner fitting of claim 1, where the receiving block includes a first bolt and a second bolt spaced apart from the first bolt, where each of the first bolt and the second bolt extend from the lower surface.

3. The corner fitting of claim 1, where the socket extends from the lower surface into the receiving block.

4. The corner fitting of claim 3, where the receiving block includes a first socket and a second socket spaced apart from the first socket, where each of the first socket and the second socket extend from the lower surface into the receiving block.

5. The corner fitting of claim 1, where the receiving block with the angle support portion is formed from a single block of a metal.

6. The corner fitting of claim 1, where the corner fittings further includes a portion of a member hinge.

7. The corner fitting of claim 6, where the portion of the member hinge is a knuckle of the member hinge.

* * * * *